US008397683B2

(12) United States Patent
Hiyoshi et al.

(10) Patent No.: US 8,397,683 B2
(45) **Date of Patent: *Mar. 19, 2013**

(54) VARIABLE COMPRESSION RATIO DEVICE FOR INTERNAL COMBUSTION ENGINE

(75) Inventors: Ryosuke Hiyoshi, Yokosuka (JP); Yoshiaki Tanaka, Fujisawa (JP); Shinichi Takemura, Yokohama (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 949 days.

This patent is subject to a terminal disclaimer.

(21) Appl. No.: 12/178,369

(22) Filed: Jul. 23, 2008

(65) Prior Publication Data

US 2009/0038588 A1 Feb. 12, 2009

(30) Foreign Application Priority Data

Aug. 10, 2007 (JP) ..... 2007-209516

(51) Int. Cl.
*F02B 75/04* (2006.01)

(52) U.S. Cl. ..... 123/48 B; 123/48 R; 123/48 A; 123/78 E; 123/78 F

(58) Field of Classification Search ..... 123/48 B, 123/78 F, 78 R, 78 E
See application file for complete search history.

(56) References Cited

U.S. PATENT DOCUMENTS

| | | | | |
|---|---|---|---|---|
| 4,475,495 | A * | 10/1984 | Lydell | 123/197.3 |
| 4,517,931 | A * | 5/1985 | Nelson | 123/48 B |
| 6,101,889 | A * | 8/2000 | Laskey | 74/89.23 |
| 6,202,623 | B1 * | 3/2001 | Ehrlich | 123/197.4 |
| 6,260,532 | B1 | 7/2001 | Mendler | |
| 6,390,035 | B2 * | 5/2002 | Moteki et al. | 123/78 BA |
| 6,491,003 | B2 | 12/2002 | Moteki | |
| 6,604,495 | B2 * | 8/2003 | Moteki | 123/48 B |
| 6,622,670 | B2 * | 9/2003 | Hiyoshi et al. | 123/48 B |
| 6,843,212 | B2 * | 1/2005 | Shimizu et al. | 123/48 B |
| 6,938,589 | B2 * | 9/2005 | Park | 123/56.4 |
| 7,021,254 | B2 * | 4/2006 | Shiraishi et al. | 123/78 E |
| 7,121,251 | B2 * | 10/2006 | Moteki et al. | 123/197.1 |
| 7,159,542 | B2 * | 1/2007 | Bryant | 123/48 B |
| 7,159,543 | B2 * | 1/2007 | Hotta et al. | 123/48 R |
| 7,334,547 | B2 * | 2/2008 | Hiraya et al. | 123/48 R |
| 7,363,902 | B2 | 4/2008 | Ushijima et al. | |
| 8,087,390 | B2 * | 1/2012 | Hiyoshi et al. | 123/78 F |
| 2001/0017112 | A1 | 8/2001 | Moteki et al. | |
| 2001/0047778 | A1 * | 12/2001 | Aoyama et al. | 123/78 R |
| 2002/0002957 | A1 | 1/2002 | Moteki et al. | |
| 2002/0043228 | A1 | 4/2002 | Moteki | |

(Continued)

FOREIGN PATENT DOCUMENTS

| | | |
|---|---|---|
| JP | 3-121083 U | 12/1991 |
| JP | 5-59028 U | 8/1993 |

(Continued)

*Primary Examiner* — Rinaldi Rada
*Assistant Examiner* — Grant Moubry
(74) *Attorney, Agent, or Firm* — Foley & Lardner LLP

(57) ABSTRACT

A variable compression ratio device for an internal combustion engine comprises a control shaft (7) that varies a compression ratio of the internal combustion engine in accordance with a rotational displacement, and a linear actuator (13, 16, 17, 18). A connecting link (12) connects a first point (14) offset from a rotation axis (7*a*) of the control shaft (7) to an actuator rod (13) of the linear actuator (13, 16, 17, 18). Thus, a bending load acting on the actuator rod (13) is reduced, and controllability of the compression ratio is improved.

16 Claims, 24 Drawing Sheets

U.S. PATENT DOCUMENTS

| | | | | |
|---|---|---|---|---|
| 2002/0050252 | A1* | 5/2002 | Moteki | 123/48 B |
| 2003/0051685 | A1* | 3/2003 | Hiyoshi et al. | 123/78 E |
| 2005/0268870 | A1* | 12/2005 | Hotta et al. | 123/78 F |
| 2006/0180118 | A1* | 8/2006 | Takemura et al. | 123/197.4 |
| 2007/0044739 | A1* | 3/2007 | Clarke | 123/78 F |

FOREIGN PATENT DOCUMENTS

| | | | |
|---|---|---|---|
| JP | 2001-227367 | A | 8/2001 |
| JP | 2002-061501 | A | 2/2002 |
| JP | 2002-115571 | A | 4/2002 |
| JP | 2003-287100 | A | 10/2003 |
| JP | 2005-030233 | A | 2/2005 |
| JP | 2005-147068 | A | 6/2005 |
| JP | 2005-163695 | A | 6/2005 |
| JP | 2005-163740 | A | 6/2005 |
| JP | 2006-183595 | A | 7/2006 |
| JP | 2006-226133 | A | 8/2006 |

* cited by examiner

WHEN ε IS IN THE VICINITY OF MINIMUM

WHEN ε IS IN THE VICINITY OF MAXIMUM

VARIABLE COMPRESSION RATIO DEVICE FOR INTERNAL COMBUSTION ENGINE

FIELD OF THE INVENTION

This invention relates to a variable compression ratio device which varies a compression ratio of an internal combustion engine via a plurality of links.

BACKGROUND OF THE INVENTION

JP2002-115571A, published by the Japan Patent Office in 2002, discloses a variable compression ratio device that connects a piston and a crankshaft of an internal combustion engine via a plurality of links so as to vary the compression ratio of the internal combustion engine. In this prior art device, the piston and the crankshaft are connected via an upper link and a lower link, and by varying the tilt of the lower link, the compression ratio is varied. The tilt of the lower link is varied using the following mechanism.

One end of a control link is connected to the lower link, and another end of the control link is connected to a control shaft, which is substantially parallel to the crankshaft, in an eccentric position. With this constitution, when the control shaft is rotationally displaced, the control link varies the tilt of the lower link.

A control plate that rotates integrally with the control shaft is provided to displace the control shaft rotationally, and a connecting pin inserted into an elongated hole formed in the control plate is driven by a linear actuator.

SUMMARY OF THE INVENTION

To latch an actuator rod to the connecting pin inserted into the elongated hole in this manner, a tip end of the actuator rod is forked, for example, and the connecting pin is caused to penetrate the elongated hole and the actuator rod with the control plate gripped between the prongs of the fork. The fork in the actuator rod must be formed deep enough to ensure that the control plate and the actuator rod do not interfere with each other when the connecting pin moves within the elongated hole.

However, forming such a deep fork in the tip end of the actuator rod causes the rigidity of the actuator rod to decrease. For example, when a rotation angle of the control shaft increases such that a component force in a transverse direction of the actuator rod, of a load acting on the actuator rod, becomes larger than a component force in an axial direction of the actuator rod, bending stress in the interior of the actuator rod increases. As a result, it may become necessary to suppress the engine output in order to reduce the bending stress of the actuator rod to an allowable stress range.

It is therefore an object of this invention to reduce a bending load acting on an actuator rod of a variable compression ratio device and improve the controllability of the compression ratio.

In order to achieve the above object, this invention provides a variable compression ratio device for an internal combustion engine, comprising a control shaft that varies a compression ratio of the internal combustion engine in accordance with a rotational displacement, a linear actuator, and a connecting link that connects the linear actuator to a first point that is offset from a rotation axis of the control shaft.

The details as well as other features and advantages of this invention are set forth in the remainder of the specification and are shown in the accompanying drawings.

DESCRIPTION OF THE PREFERRED EMBODIMENTS

Figure 1:
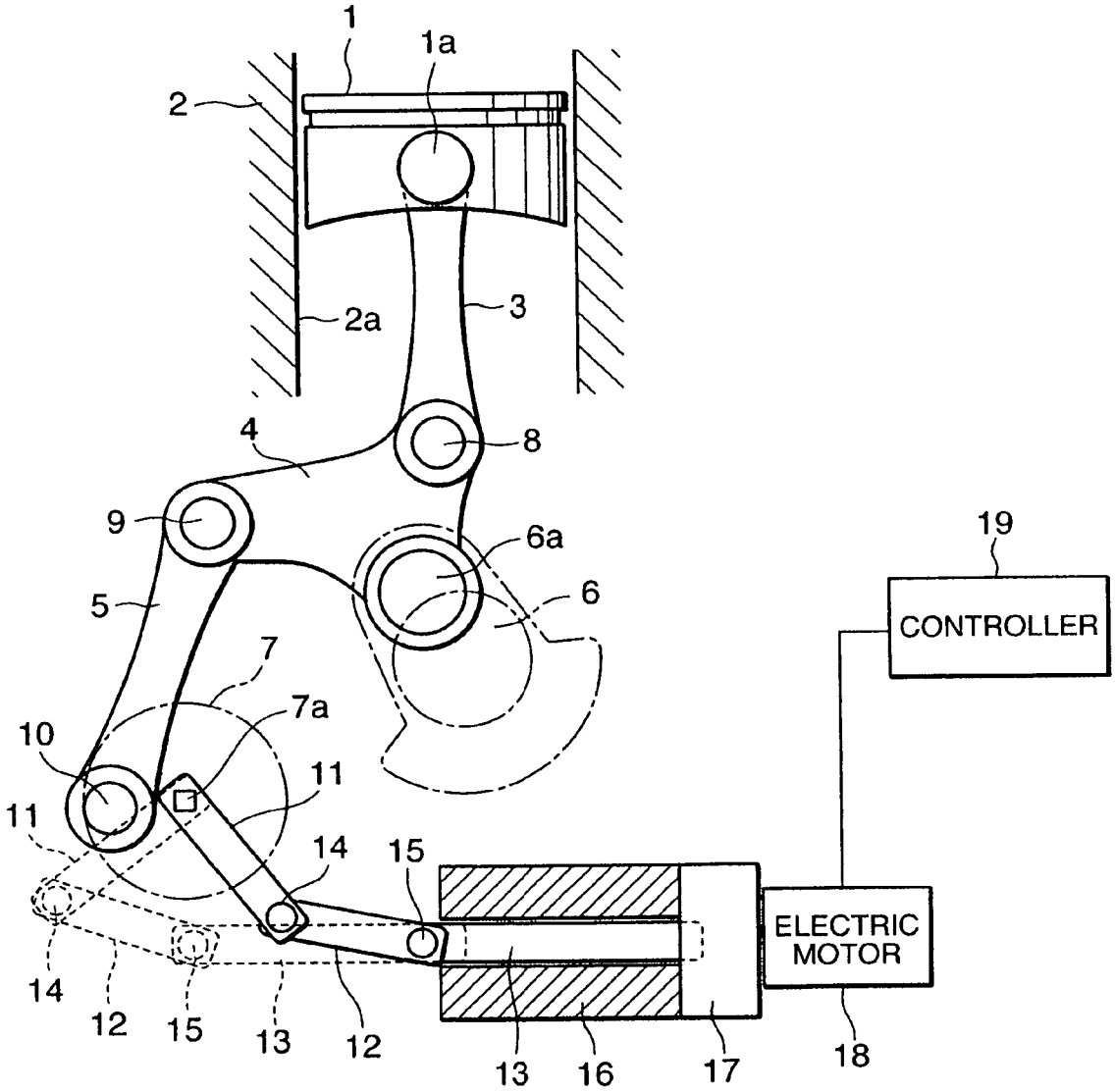
FIG. 1 is a schematic diagram of a variable compression ratio device according to this invention.

Referring to FIG. 1 of the figures, a piston 1 of an internal combustion engine is accommodated in a cylinder 2*a* formed in a cylinder block 2 so as to be capable of performing a reciprocating motion therein.

One end of an upper link 3 is coupled to the piston 1 via a piston pin 1*a*. Another end of the upper link 3 is coupled to a lower link 4 via a pin 8. The lower link 4 is connected to a crankshaft 6 via a crank pin 6*a*. The reciprocating motion of the piston 1 within the cylinder 2*a* therefore causes the crankshaft 6 to rotate via the upper link 3 and the lower link 4.

Here, a compression ratio of the cylinder 2*a* generated by the reciprocating motion of the piston 1 varies according to an angle formed by the upper link 3 and the lower link 4. A variable compression ratio device according to this invention varies the angle formed by the upper link 3 and lower link 4 by rotating the lower link 4 about the crank pin 6*a*.

For this purpose, one end of a control link 5 is coupled to the lower link 4 via a pin 9. The lower link 4 has a substantially triangular shape, the three vertices of which are connected to the upper link 3, the crankshaft 6, and the control link 5, respectively, via the pin 8, the crank pin 6*a*, and the pin 9.

Another end of the control link 5 is connected to a control shaft 7 that is parallel to the crankshaft 6 via an offset pin 10. A connection point at which the offset pin 10 connects the control link 5 to the control shaft 7 is provided in an offset position from the center of the control shaft 7. This setting is realized by fixing an eccentric cam to the control shaft and providing the eccentric cam with the connection point, for example.

With the above constitution, when the control shaft 7 undergoes rotational displacement, the offset pin 10 offset from the center of the control shaft 7 displaces in an arc-shaped locus around the center of the control shaft 7, thereby rotating the lower link 4 via the control link 5. As a result, the angle formed by the upper link 3 and lower link 4 varies, leading to variation in the compression ratio of the cylinder 2*a*.

It should be noted that in the following description, the compression ratio is defined as follows. The compression ratio expresses the volume of a combustion chamber at bottom dead center of the piston 1 when the volume of the combustion chamber at top dead center of the piston 1 is assumed to be one. A maximum compression ratio is a compression ratio at which the combustion chamber volume at top dead center of the piston 1 reaches a minimum relative to the combustion chamber volume at bottom dead center of the piston 1. A minimum compression ratio is a compression ratio at which the combustion chamber volume at top dead center of the piston 1 reaches a maximum relative to the combustion chamber volume at bottom dead center of the piston 1.

As a drive mechanism for rotationally displacing the control shaft 7, the variable compression ratio device comprises a fixing lever 11, a connecting link 12, an actuator rod 13, and an electric motor 18 that screw-feeds the actuator 13 via a ball screw reduction gear 17. An operation of the electric motor 18 is controlled by a programmable controller 19.

One end of the fixing lever 11 is fixed to a rotation axis 7*a* of the control shaft 7. As a result, the control shaft 7 undergoes rotational displacement in accordance with the rotation of the fixing lever 11. Another end of the fixing lever 11 is connected to one end of the connecting link 12 via a connecting pin 14. Another end of the connecting link 12 is connected to a tip end of the actuator rod 13 via a connecting pin 15. Both ends of the connecting link 12 are forked, and the fixing lever 11 is connected to the connecting link 12 by the connecting pin 14, which penetrates the fork on one end of the connecting link 12 and one end portion of the fixing lever 11, the end portion of the fixing lever 11 being inserted into the fork. Similarly, the actuator rod 13 is connected to the connecting link 12 by the connecting pin 15, which penetrates the fork on the other end of the connecting link 12 and an end portion of the actuator rod 13, the end portion of the actuator rod 13 being inserted into the fork.

A male screw is formed on an outer periphery of the actuator rod 13. The ball screw reduction gear is constituted by a housing 16 and a reduction gear 17. A base end of the actuator rod 13 is accommodated in the housing 16. A screw feeding mechanism which is screwed to the male screw of the actuator rod 13 and converts a rotary motion into an axial motion is provided in the housing 16. The reduction gear 17 reduces the rotation of the electric motor 18 and transmits the reduced rotation to the screw feeding mechanism.

On the basis of this drive mechanism, when the actuator rod 13 retreats from a broken line position indicated in the figure to a solid line position within the housing 16, the control shaft 7 undergoes rotational displacement in a counter-clockwise direction of the figure about the rotation axis 7*a* via the connecting link 12 and the fixing lever 11. When the control shaft 7 undergoes counter-clockwise rotational displacement from the position in the figure, the position of the offset pin 10 falls. When the offset pin 10 falls, the lower link 4 undergoes counter-clockwise rotational displacement about the crank pin 6*a* via the control link 5. When the lower link 4 undergoes counter-clockwise rotational displacement, the position of the pin 8 rises. When the position of the pin 8 rises, the position of the piston 1 within the cylinder 2*a* rises via the upper link 3. As a result, a stroke range of the piston 1 within the cylinder 2*a* moves upward. As a result of this movement, the compression ratio of an air-fuel mixture in the cylinder 2*a*, which is generated by the piston 1, increases. A solid line in the figure shows a state close to the maximum compression ratio.

On the other hand, when the actuator rod 13 displaces in a projecting direction from the housing 16, as shown by the broken line in the figure, the control shaft 7 and lower link 4 undergo rotational displacement in a clockwise direction of the figure such that the position of the piston 1 in the cylinder 2*a* falls. As a result, the stroke range of the piston 1 within the cylinder 2*a* moves downward. As a result of this movement, the compression ratio generated by the piston 1 in the air-fuel mixture in the cylinder 2*a* decreases.

The displacement direction and distance of the actuator rod 13 relative to the housing 16 are determined by operation control of the electric motor 18, which is performed by the controller 19.

The controller 19 is constituted by a microcomputer comprising a central processing unit (CPU), read-only memory (ROM), random access memory (RAM), and an input/output interface (I/O interface). The controller may be constituted by a plurality of microcomputers.

Combustion pressure in the cylinder 2*a* and an inertial force of the piston 1 are transmitted to the control shaft 7 via the upper link 3, lower link 4, and control link 5. The offset pin 10 is offset from the rotation axis 7*a* of the control shaft 7, and therefore the load thereof acts as a load that rotates the control shaft 7. In the following description, this load acting on the control shaft 7 will be referred to as control shaft torque Tcs.

The variable compression ratio device comprises a holding mechanism for holding the control shaft 7 at a predetermined rotation angle against the control shaft torque Tcs. The holding mechanism may be constituted by a program set in the controller 19 to control the operation of the electric motor 18 such that torque in an opposite direction to the acting direction of the control shaft torque Tcs is applied to the control shaft 7, or by a mechanism that mechanically locks rotational displacement of the control shaft 7.

With the constitution described above, the controller 19 varies the compression ratio of the internal combustion engine in accordance with operating conditions via the drive mechanism.

The specific content of compression ratio control corresponding to operating conditions is disclosed in JP2002-115571A described above. The content thereof is incorporated herein by reference, and description thereof has been omitted.

Next, the arrangement of the fixing lever 11, connecting link 12, and offset pin 10 will be described.

Figure 2:
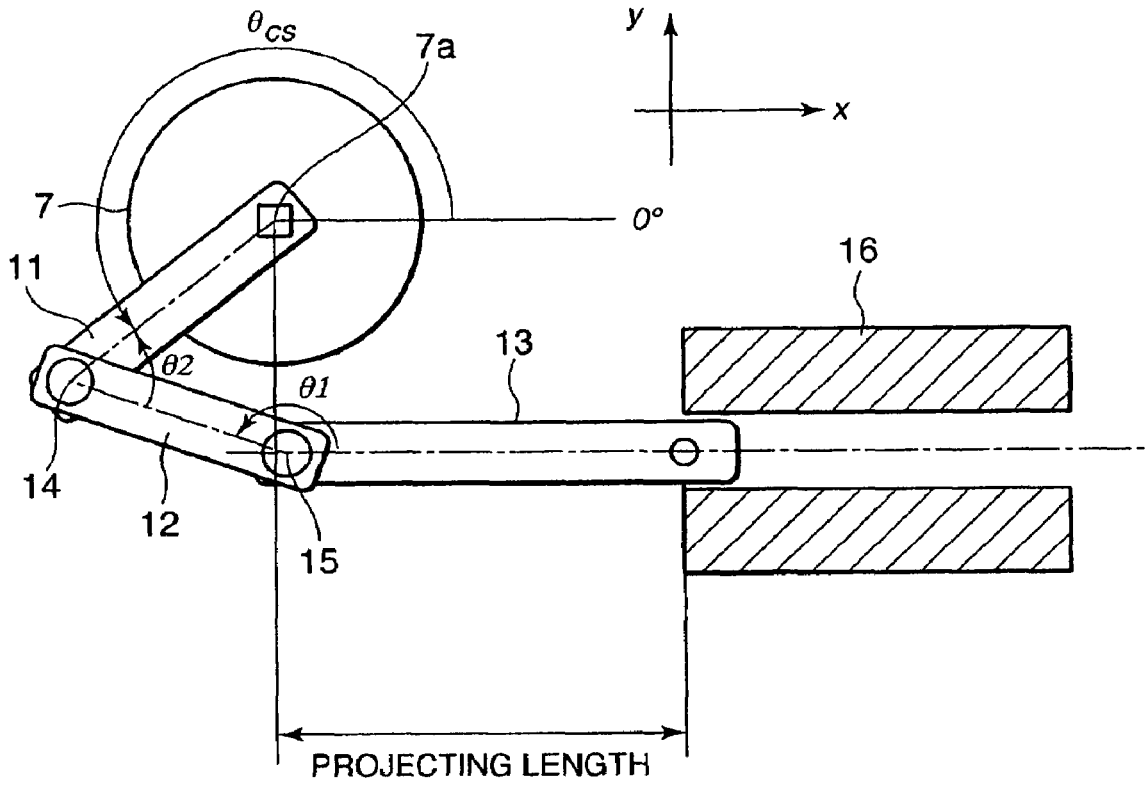
FIG. 2 is a schematic diagram of a connection mechanism that connects a control shaft and an actuator according to this invention.

FIG. 2 shows the arrangement of the control shaft 7, fixing lever 11, connecting link 12, and actuator rod 13 of the variable compression ratio device shown in FIG. 1 in a case where the internal combustion engine is set substantially at the minimum compression ratio.

In the figure, an angle formed by the connecting link 12 and the actuator rod 13 is set as $\theta_1$, an angle formed by the fixing lever 11 and the connecting link 12 is set as $\theta_2$, and the rotation angle of the control shaft 7 is set as $\theta_{cs}$. Using the rotation axis 7*a* as an origin, a horizontal direction is set as an X axis and a perpendicular direction thereto is set as a Y axis. Accordingly, the rotation angle $\theta_{cs}$ of the control shaft 7 is expressed by an angle formed by the X axis and the fixing lever 11. When measuring the angle, the counter-clockwise direction of the figure is set as a positive direction.

Figure 3:
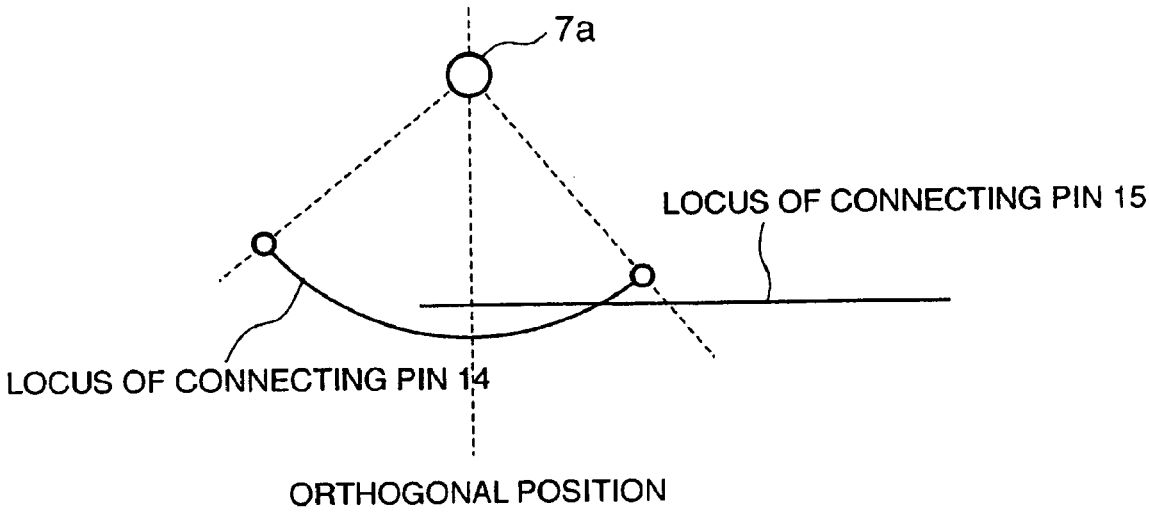
FIG. 3 is a diagram showing a locus of a connecting pin that connects a fixing lever and a connecting link according to this invention.

FIG. 3 shows loci of the connecting pins 14 and 15 when the actuator rod 13 is caused to project from the housing 16 or caused to retreat into the housing 16. The locus of the connecting pin 14 forms an arc centering on the rotation axis 7*a* of the control shaft 7. In this embodiment, the layout and dimensions of members including the drive mechanism are set such that the locus of the connecting pin 14 and an axis of the actuator rod 13 intersect at two compression ratios between the minimum compression ratio and the maximum compression ratio.

Figure 7A:
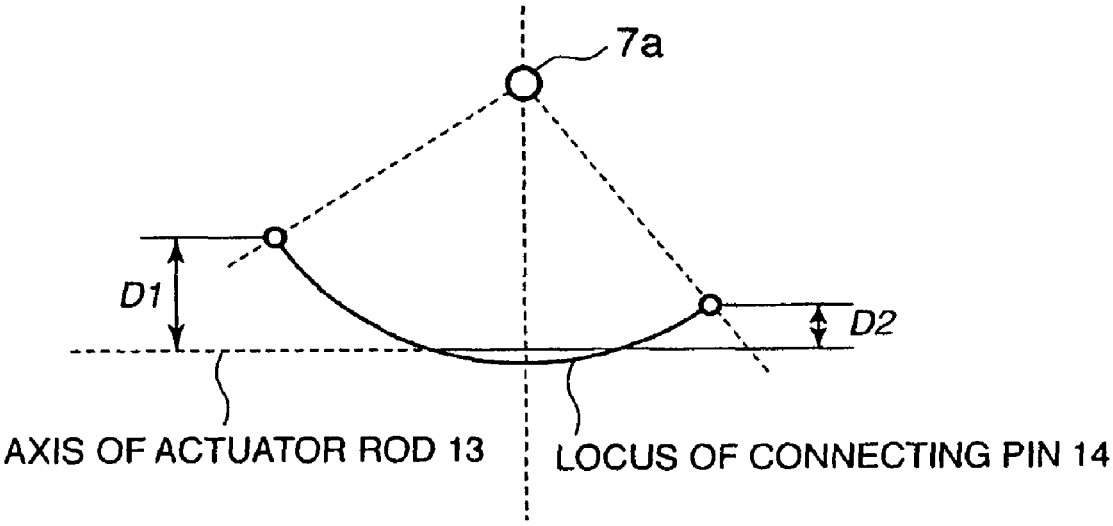
FIGS. 7A and 7B are diagrams showing a relationship between the locus of the connecting pin and an actuator rod axis.
Figure 7B:
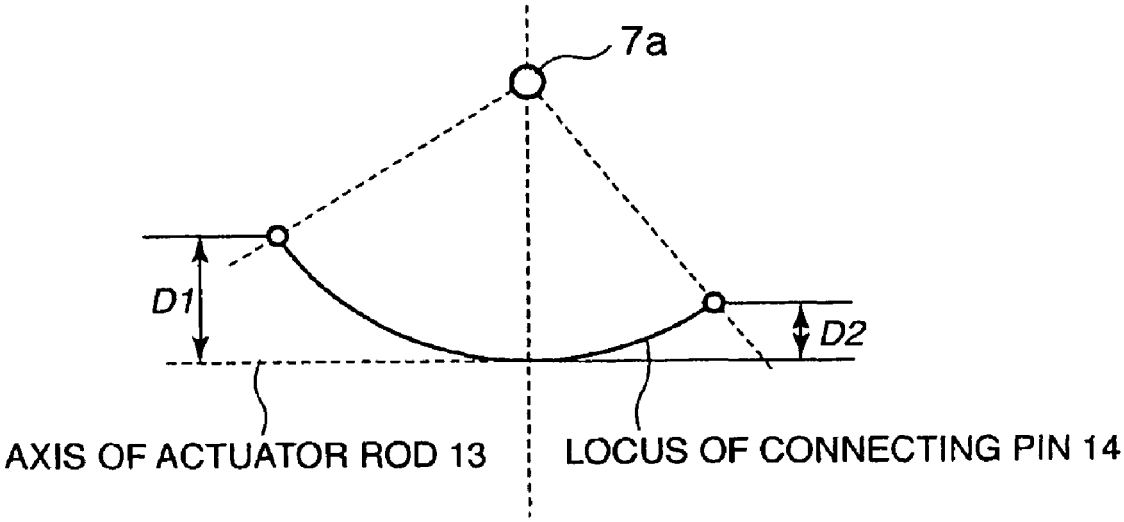

FIG. 7A shows a condition in which the locus of the connecting pin 14 and the axis of the actuator rod 13 intersect at two compression ratios between the minimum compression ratio and the maximum compression ratio. FIG. 7B shows a case in which the locus of the connecting pin 14 and the axis of the actuator rod 13 do not intersect. In the case shown in FIG. 7A, a distance between the connecting pin 14 and the axis of the actuator rod 13 over the entire compression ratio region from the maximum compression ratio to the minimum compression ratio, or in other words D1 and D2 in the figure, can be suppressed to be smaller than that of the case shown in FIG. 7B. As a result, a bending load applied to the actuator rod 13 by the housing 16 can be reduced in a contact portion between the actuator rod 13 and the housing 16.

In FIG. 7A, a movement region of the connecting pin 14 is set such that a region on the left side of a perpendicular extending from the rotation axis 7*a* of the control shaft 7 is larger than a region on the right side. In other words, in relation to the distances D1 and D2 between the connecting pin 14 and the axis of the actuator rod 13 at either end of the locus of the connecting pin 14, D1 is set to be greater than D2 at all times.

Figure 8:
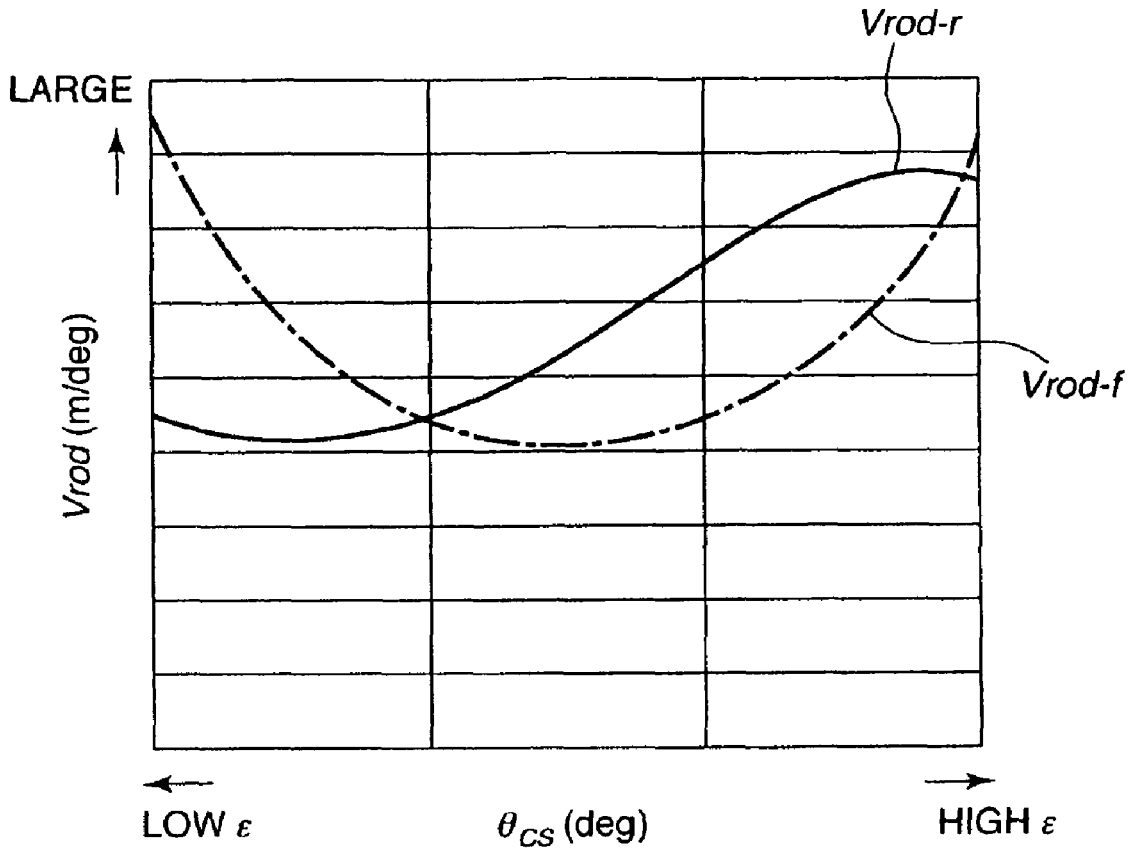
FIG. 8 is a diagram showing a relationship between an actuator rod movement distance corresponding to control shaft angular variation and the compression ratio.

FIG. 8 shows a relationship between the rotation angle $\theta_{cs}$ of the control shaft 7 and a movement amount Vrod of the actuator rod 13 per unit rotation angle of the control shaft 7 corresponding to this setting. The movement amount Vrod of the actuator rod 13 may be replaced by a rotation speed of the electric motor 18.

The abscissa in FIG. 8 shows the rotation angle $\theta_{cs}$ of the control shaft 7, and the ordinate shows the movement amount Vrod of the actuator rod 13. A solid line Vrod-r in the figure represents this embodiment. A dot-dash line Vrod-f in the figure represents the movement amount Vrod in the case of a forked connecting mechanism such as that of the prior art. In this embodiment, as the rotation angle $\theta_{cs}$ of the control shaft 7 increases, the control shaft 7 rotates further in the counter-clockwise direction of the figure, leading to an increased compression ratio.

As shown in FIG. 8, in this embodiment, the movement amount Vrod of the actuator rod 13 per rotation angle of the control shaft 7 is larger at a high compression ratio than a low compression ratio. In other words, variation in the rotation angle $\theta_{cs}$ of the control shaft 7 corresponding to the movement amount of the actuator rod 13 or the rotation speed of the electric motor 18 is smaller at a high compression ratio than a low compression ratio.

As a result, the rotation angle $\theta_{cs}$ of the control shaft 7 can be controlled with a high degree of precision at a high compression ratio. Moreover, the effect of bending displacement of the actuator rod 13 on the rotation angle $\theta_{cs}$ of the control shaft 7 can be suppressed.

Figure 4:
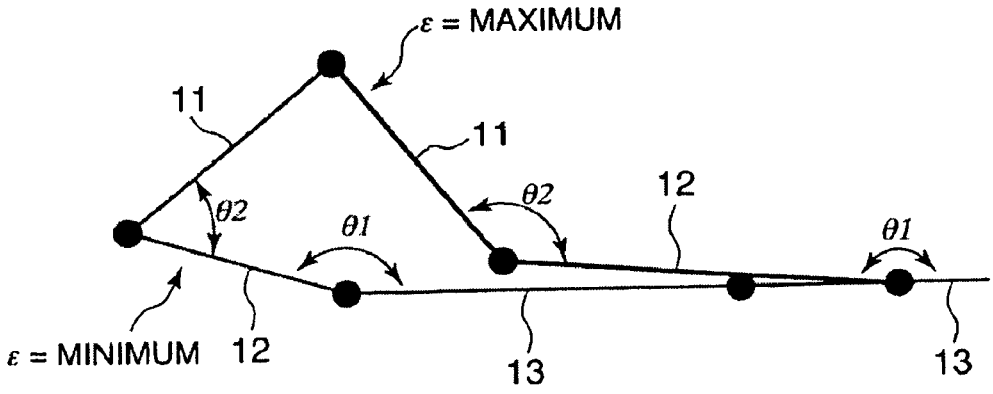
FIG. 4 is a diagram illustrating positional relationships between the fixing lever, the connecting link, and an actuator rod at a maximum compression ratio and a minimum compression ratio.

Referring to FIG. 4, positional relationships between the fixing lever 11, connecting link 12, and actuator rod 13 at the maximum compression ratio and the minimum compression ratio will be described. In this embodiment, the angle $\theta_1$ formed by the connecting link 12 and the actuator rod 13 at the maximum compression ratio is set to be closer to 180 degrees than $\theta_1$ at the minimum compression ratio. In other words, the connecting link 12 and actuator rod 13 are set to be closer to a straight line at the maximum compression ratio than at the minimum compression ratio.

Figure 9A:
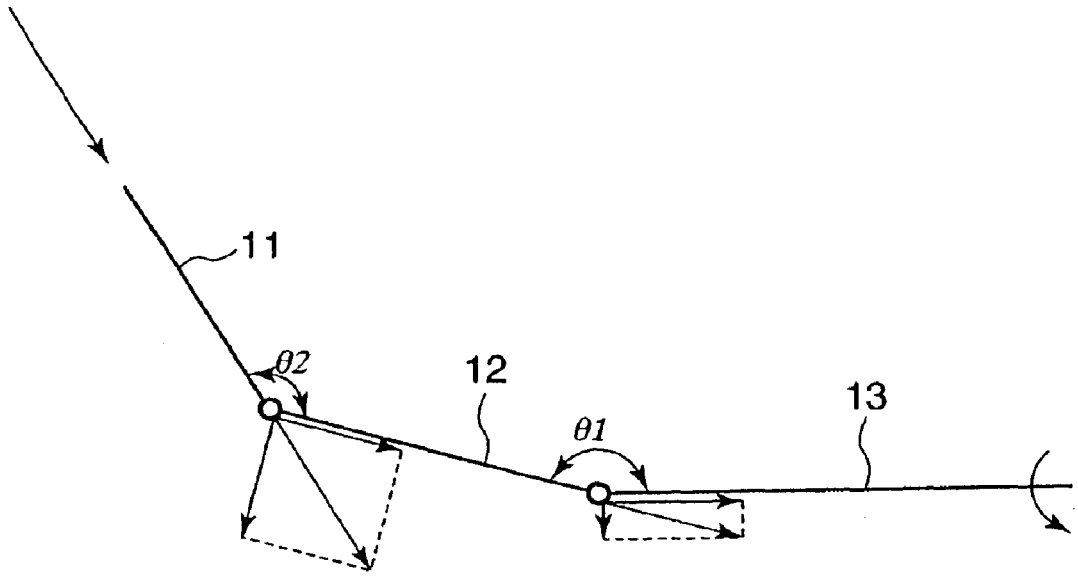
FIGS. 9A and 9B are diagrams illustrating torque transmission from the fixing lever to the actuator rod.
Figure 9B:
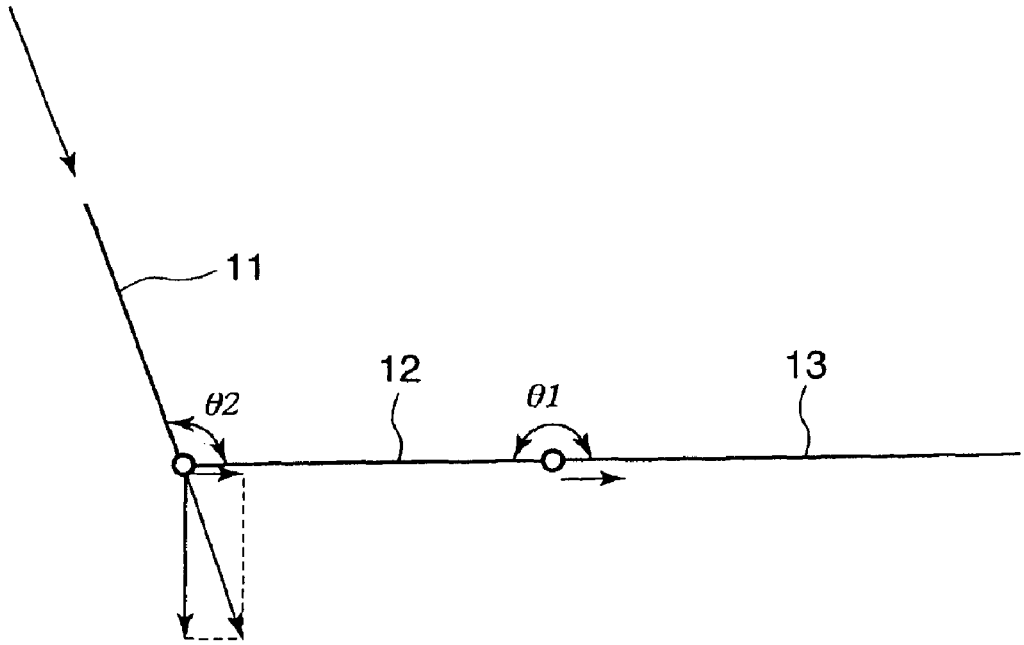

Referring to FIGS. 9A and 9B, the effect of this setting will be described.

These figures illustrate transmission of the control shaft torque Tcs from the fixing lever 11 to the actuator rod 13. FIG. 9A shows a case in which the angle $\theta_1$ formed by the connecting link 12 and actuator rod 13 is smaller than 180 degrees, and FIG. 9B shows a case in which the angle $\theta_1$ is equal to 180 degrees.

As shown in FIG. 9A, when the angle $\theta_1$ is smaller than 180 degrees, of the control shaft torque Tcs acting on the fixing lever 11, a component force acting in an axial direction of the connecting link 12 is transmitted to the connecting link 12. Of the component force transmitted to the connecting link 12, an axial direction component force relative to the actuator rod 13 acts in the axial direction of the actuator rod 13. Meanwhile, a perpendicular direction component force relative to the actuator rod 13 acts as a bending load on the actuator rod 13.

As shown in FIG. 9B, when the connecting link 12 and the actuator rod 13 form a straight line, the load transmitted to the actuator rod 13 from the connecting link 12 does not include a perpendicular direction component force relative to the actuator rod 13. Hence, in this case, no bending load acts on the actuator rod 13.

The bending load acting on the actuator rod 13 increases as the connecting link 12 and the actuator rod 13 deflect and decreases as the connecting link 12 and the actuator rod 13 approach a straight line. In other words, in the variable compression ratio device, the bending load acting on the actuator rod 13 increases as the compression ratio increases.

Figure 5:
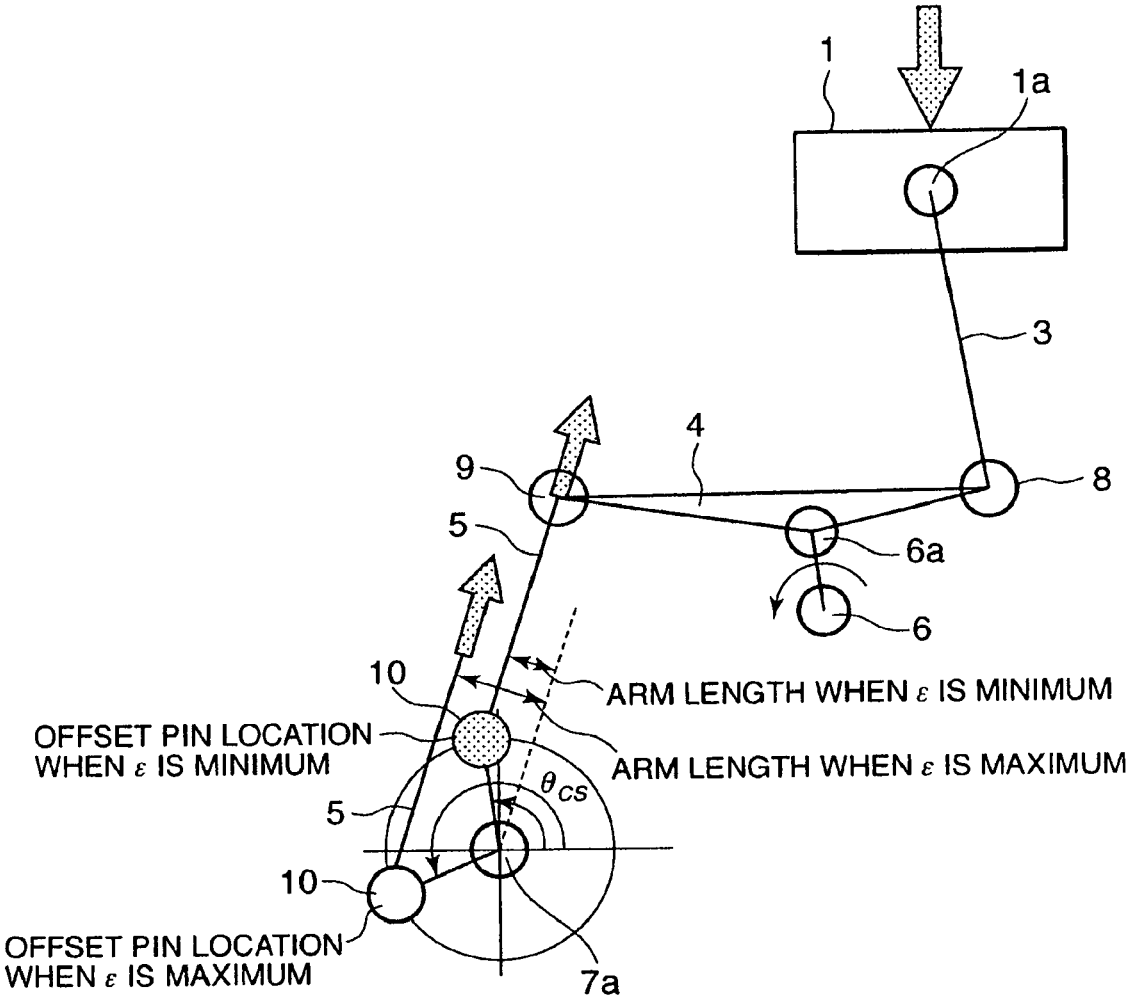
FIG. 5 is a diagram showing the position of the offset pin at the maximum compression ratio and the minimum compression ratio.

Referring to FIG. 5, the position of the offset pin 10 at the maximum compression ratio and the position of the offset pin 10 at the minimum compression ratio will be described. The variable compression ratio device according to this embodiment is set such that the rotation angle $\theta_{cs}$ of the control shaft 7 is close to 90 degrees at the minimum compression ratio and close to 180 degrees at the maximum compression ratio.

Figure 10A:
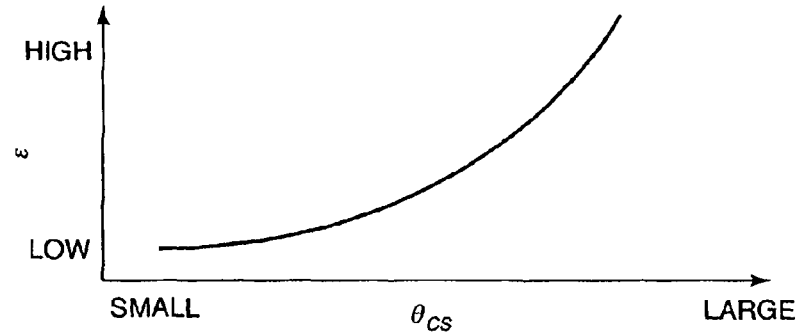
FIGS. 10A-10D are a diagram showing a relationship of a control shaft angle $\theta_{cs}$ with a compression ratio $\epsilon$ and a torque Tcs applied to the control shaft, a diagram showing a relationship between the compression ratio $\epsilon$ and a value Tcs/L obtained by dividing the torque Tcs applied to the control shaft by a fixing lever length L, and a diagram showing a relationship between the compression ratio $\epsilon$ and the projecting length of the actuator rod.

As a result of this setting, the compression ratio increases as the rotation angle $\theta_{cs}$ of the control shaft 7 increases. Further, as shown in FIG. 10A, an increase rate of the compression ratio per unit rotation angle increases as the rotation angle $\theta_{cs}$ of the control shaft 7 increases.

Moreover, in FIG. 5, an axial direction load of the control link 5, which is transmitted via the offset pin 10, effects a rotary moment about the rotation axis 7*a* on the control shaft 7. An effective arm length of this moment increases as the compression ratio increases.

Figure 10B:
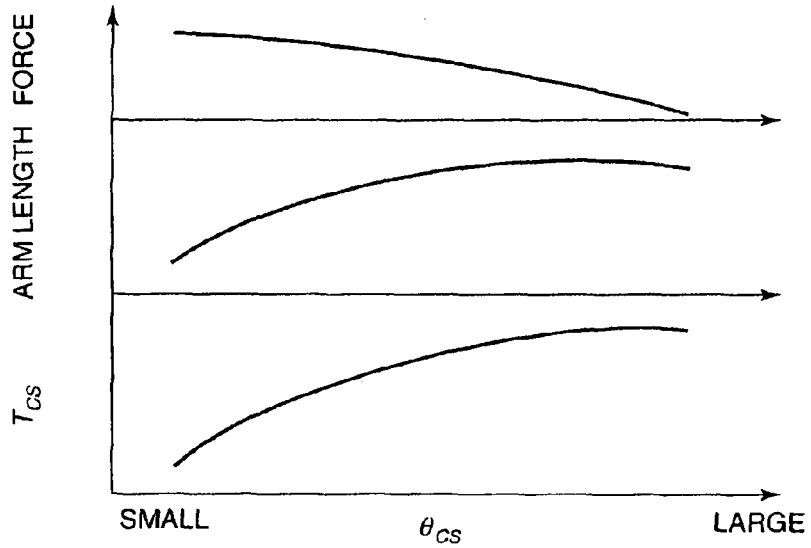
Figure 10C:
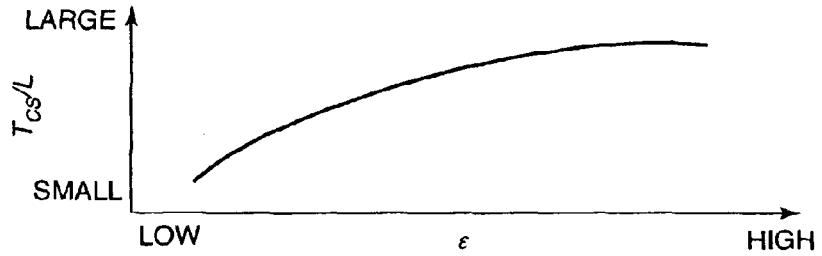

The variable compression ratio device controls the rotation position of the control shaft 7 such that the compression ratio is low when an engine load is high and the compression ratio is high when the engine load is low. Accordingly, an axial direction force of the control link 5 decreases as the compression ratio increases. The control shaft torque Tcs is expressed by the product of the axial direction force of the control link 5 and the effective arm length. Considering the variation range of the two, variation in the effective arm length has a greater effect on the control shaft torque Tcs than variation in the axial direction force of the control link 5. As a result, the control shaft torque Tcs increases as the compression ratio increases, as shown in FIG. 10B. Further, a load Tcs/L obtained by dividing the control shaft torque Tcs by a length L of the fixing lever 11 also increases as the compression ratio increases.

Figure 6:
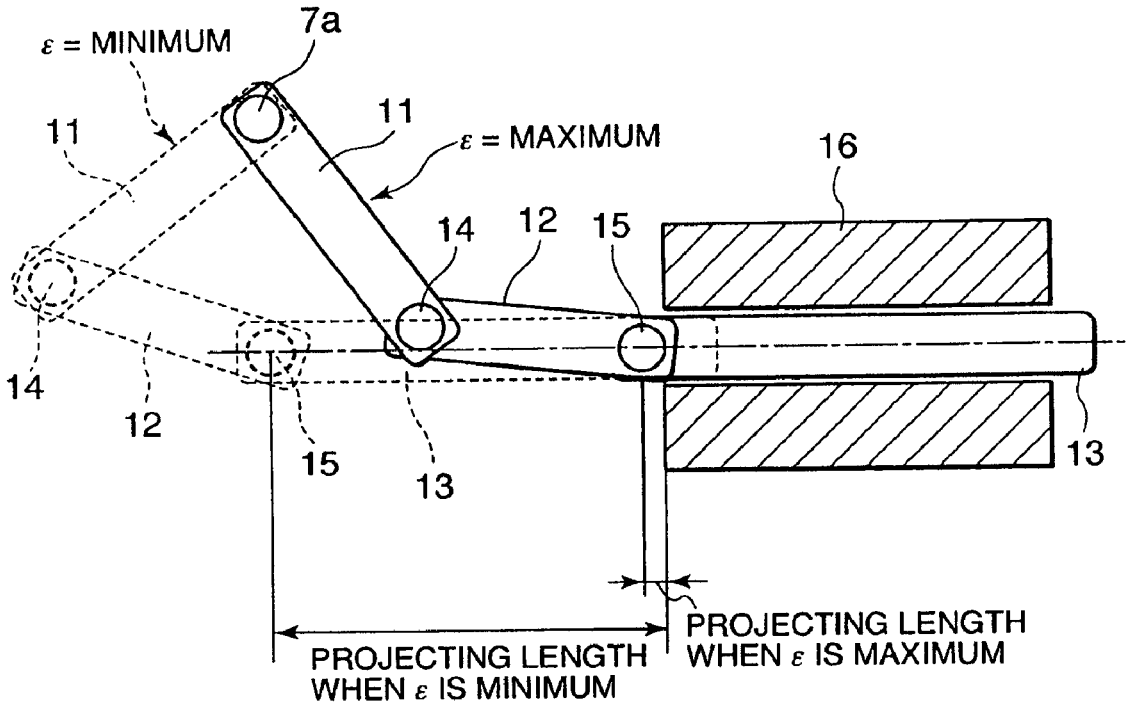
FIG. 6 is a diagram showing a projecting length of the actuator rod at the maximum compression ratio and the minimum compression ratio.

Referring to FIG. 6, relative positions between the actuator rod 13 and the housing 16 at the maximum compression ratio and the minimum compression ratio will be described. As shown in the figure, the projection amount of the actuator rod 13 from the housing 16 reaches a minimum at the maximum compression ratio and reaches a maximum at the minimum compression ratio.

Figure 10D:
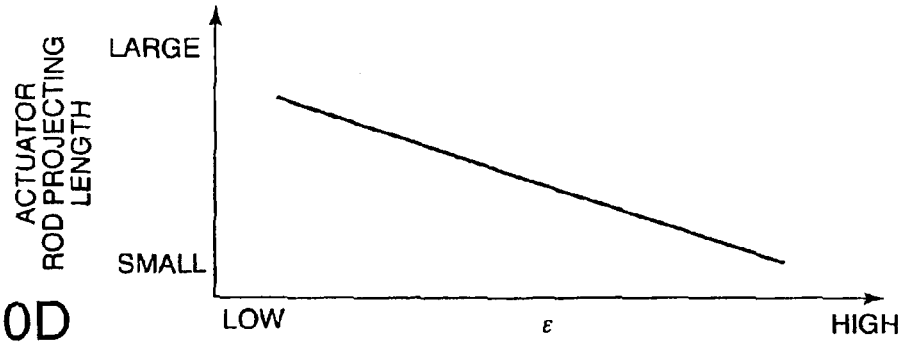

As noted above, in the variable compression ratio device, the bending load acting on the actuator rod 13 increases as the compression ratio increases. As shown in FIG. 10D, on the other hand, the projection amount of the actuator rod 13 from the housing 16 is small at a high compression ratio, and therefore the actuator rod 13 can achieve a high bearing capacity relative to the bending load. At a low compression ratio, when the bending load is small, the projection amount of the actuator rod 13 from the housing 16 is large. Thus, bending stress generated in the actuator rod 13 can be suppressed to a low level over the entire compression ratio region.

By means of this setting, divergence between an actual compression ratio and a target compression ratio due to bending deformation of the actuator rod 13 can be reduced. Furthermore, since bending stress on the actuator rod 13 can be suppressed to a low level, the diameter of the actuator rod 13 and the size of a support structure for the actuator rod 13 can be reduced.

When bending stress on the actuator rod 13 is suppressed to a low level, friction occurring between the actuator rod 13 and the housing 16 when the actuator rod 13 expands and contracts relative to the housing 16 can also be suppressed to a low level. As a result, the responsiveness of a compression ratio modification operation improves.

Figure 11A:
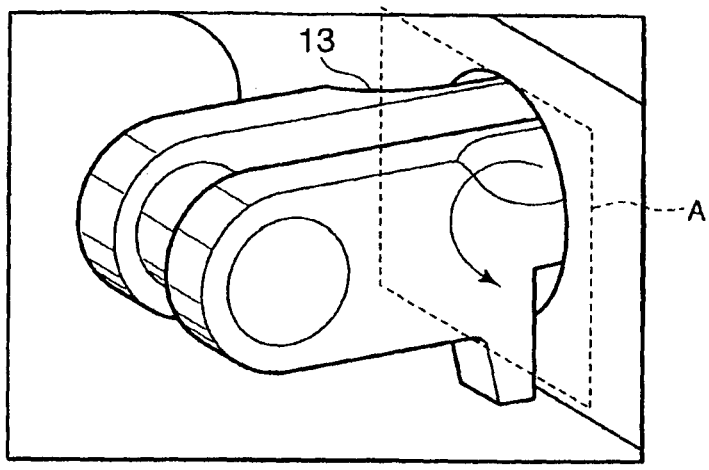
PRIOR ART FIG. 11A
FIGS. 11A-11C are a perspective view of a connection portion between the actuator rod and the control plate according to the prior art, a transverse sectional view of the actuator rod according to the prior art, and a transverse sectional view of the actuator rod according to this invention.
Figure 11B:
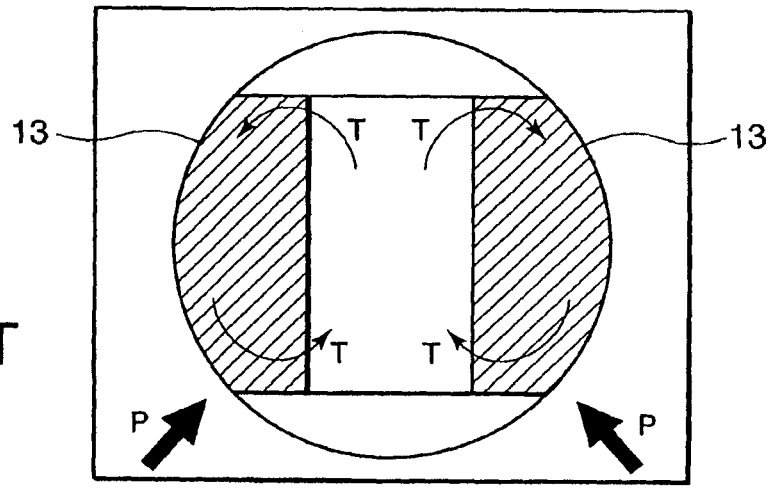
PRIOR ART FIG. 11B
Figure 11C:
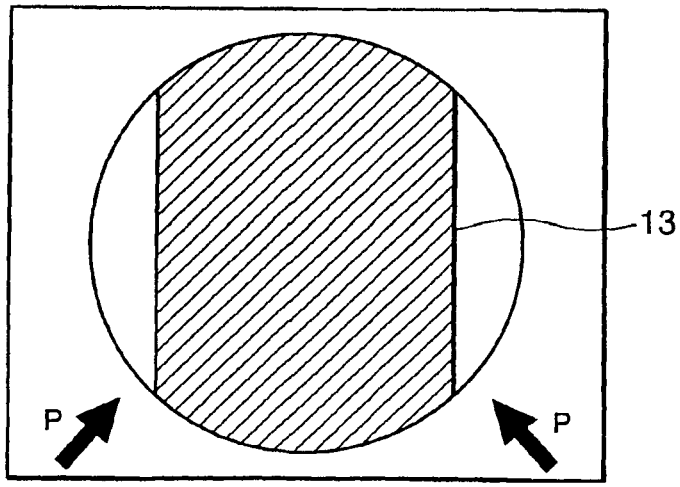

Referring to FIGS. 11A-11C, the shape of the actuator rod 13 will be described. FIG. 11A shows an actuator rod applied to the forked connection mechanism according to the prior art. FIG. 11B shows an outline of the cross-section of the actuator rod 13 in a region A surrounded by a broken line in FIG. 11A. FIG. 11C shows an outline of the cross-section of the actuator rod 13 to which the variable compression ratio device according to this embodiment is applied.

FIG. 11A shows a state in which a fork is formed in the tip end of the actuator rod 13 employed in the variable compression ratio device according to the prior art.

When the actuator rod 13 is brought into contact with the housing 16 by a bending load indicated by an arrow in FIG. 11A, the actuator rod 13 receives a reactive force, indicated by an arrow P in FIG. 11B, from the housing 16, and as a result, a bending moment indicated by an arrow T in the figure acts on the forked part. As a result of this bending moment, bending deformation occurs in the actuator rod 13 such that great bending stress is generated in a root part of the forked portion. This bending stress increases as the depth of the fork increases.

In the variable compression ratio device according to this embodiment, on the other hand, the tip end portion of the actuator rod 13 does not need to be forked. Hence, as shown in FIG. 11C, even upon reception of a reactive force such as that shown by the arrow P, bending torque such as that shown by the arrow T in FIG. 11B does not act on the actuator rod 13. Accordingly, stress concentration on the tip end portion of the actuator rod 13 can be avoided.

It should be noted that only tension or a compression load, and no bending load, acts on the connecting link 12, and therefore, even when the end portion of the connecting link 12 is forked, stress concentration on the root of the fork can be avoided.

Figure 12:
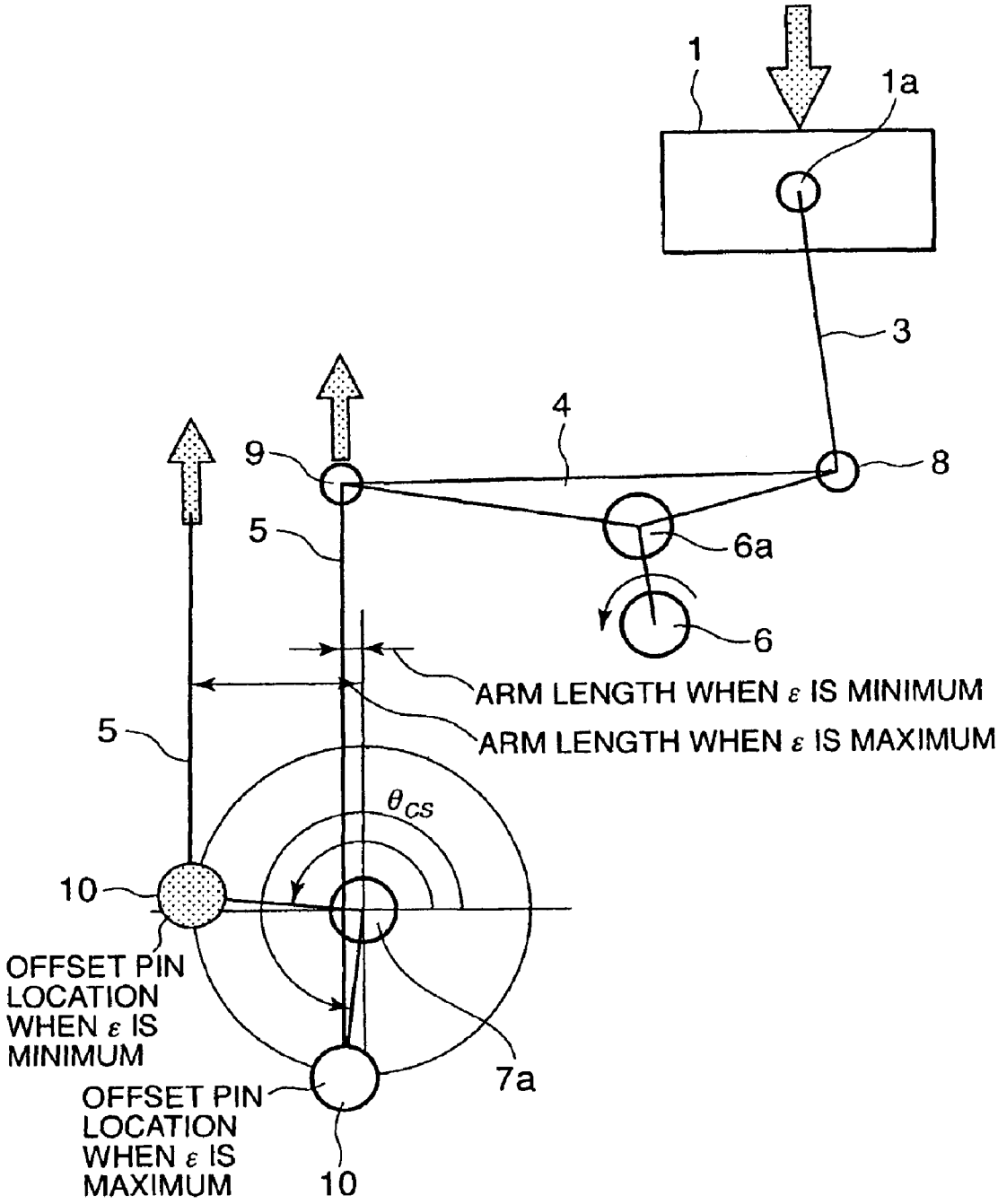
FIG. 12 is a diagram showing a rotation position of a offset pin according to a second embodiment of this invention.
Figure 13:
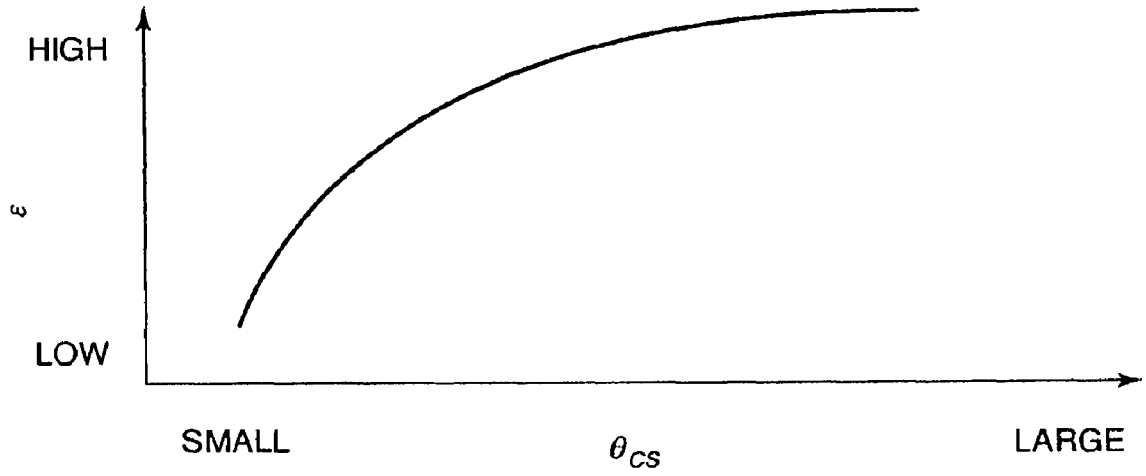
FIG. 13 is a diagram showing a relationship between the control shaft angle $\theta_{cs}$ and the compression ratio $\epsilon$ according to the second embodiment of this invention.

Referring to FIGS. 12 and 13, a second embodiment of this invention will be described. FIG. 12 and FIG. 13 correspond to FIG. 5 and FIG. 10A of the first embodiment, respectively.

Similarly to the first embodiment, a variable compression ratio device according to this embodiment is constituted such that the movement amount of the actuator rod 13 per rotation angle of the control shaft 7 is larger at a high compression ratio than a low compression ratio.

As shown in FIG. 12, the rotation angle $\theta_{cs}$ of the control shaft 7 is set to be close to 180 degrees at the minimum compression ratio and to be close to 270 degrees at the maximum compression ratio.

By means of this setting, the compression ratio increases as the rotation angle $\theta_{cs}$ of the control shaft 7 increases. However, in contrast to the first embodiment, the increase rate of the compression ratio per unit rotation angle decreases as the rotation angle $\theta_{cs}$ of the control shaft 7 increases as shown in FIG. 13. In other words, variation in the compression ratio relative to variation in the rotation angle $\theta_{cs}$ of the control shaft 7 decreases as the compression ratio approaches the maximum compression ratio, and therefore the precision of compression ratio control at a high compression ratio can be improved even further.

Referring to FIGS. 14A and 14B, FIGS. 15-17, FIGS. 22A and 22B, FIGS. 23A-23G, and FIGS. 24A-24G, a third embodiment of this invention will be described.

Figure 14A:
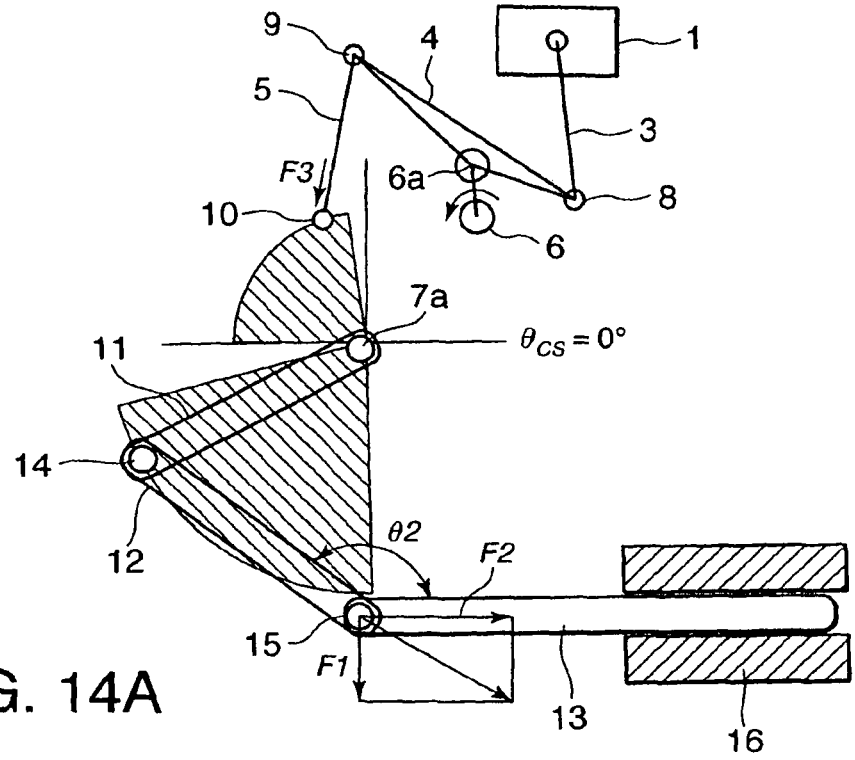
FIGS. 14A and 14B are diagrams showing a movable range of a variable compression ratio device according to a third embodiment of this invention.
Figure 14B:
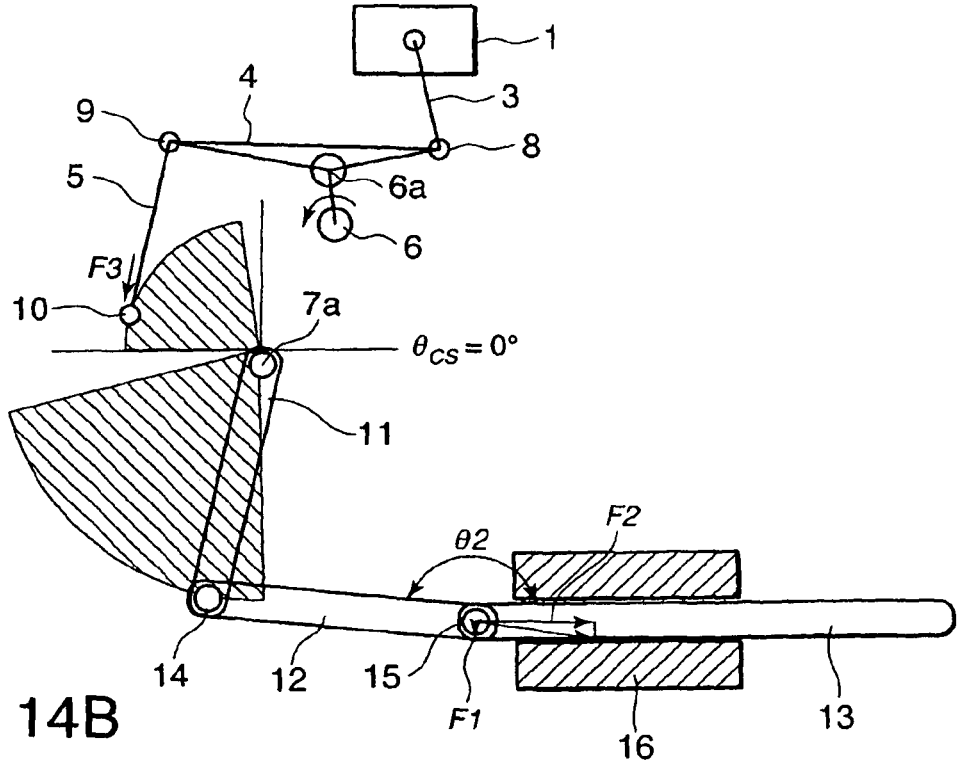

FIG. 14A shows the state of the variable compression ratio device in the vicinity of the minimum compression ratio. FIG. 14B shows the state of the variable compression ratio device in the vicinity of the maximum compression ratio.

In this embodiment, similarly to the first embodiment, the rotation angle $\theta_{cs}$ of the control shaft 7 at the minimum compression ratio is close to 90 degrees, and the rotation angle $\theta_{cs}$ of the control shaft 7 at the maximum compression ratio is close to 180 degrees. Accordingly, the effective arm length by which a load F3 acting on the control shaft 7 is converted into the control shaft torque Tcs reaches a maximum at the maximum compression ratio.

Further, the fixing lever 11, connecting link 12, and actuator rod 13 are disposed such that the angle $\theta_2$ formed by the connecting link 12 and the actuator rod 13 reaches a maximum at the maximum compression ratio. Here, of the load applied to the actuator rod 13 by the connecting link 12, a component that acts in a transverse direction of the actuator rod 13 is set as F1, and a component that acts in the axial direction is set as F2. By setting $\theta_2$ in the manner described above, a ratio between F1 and F2, or in other words F1/F2, reaches a minimum at the maximum compression ratio.

The control shaft torque Tcs, which is expressed by the product of the load F3 acting on the control shaft 7 and the effective arm length, is affected more greatly by the effective arm length. Therefore, the control shaft torque Tcs reaches a maximum at the maximum compression ratio. At the compression ratio at which the effective arm length reaches a maximum, or in other words the compression ratio at which the control shaft torque Tcs reaches a maximum, the ratio between F1 and F2 reaches a minimum.

The component F1 in the transverse direction of the actuator rod 13 acts on the actuator rod 13 as a bending load. Therefore, as F1/F2 decreases, the bending load acting on the actuator rod 13 decreases relatively.

By ensuring that F1/F2 reaches a minimum when the control shaft torque Tcs is at its maximum value, the bending load on the actuator rod 13 can be reduced relatively. As a result, the diameter of the actuator rod 13 can be reduced.

By reducing the bending load and the diameter of the actuator rod 13, friction between the housing 16 and the actuator rod 13 decreases, enabling an improvement in the responsiveness of the compression ratio modification operation.

As a result of the setting shown in FIGS. 14A and 14B, an amount of displacement in the piston top dead center position per unit rotation angle of the control shaft 7 is larger at a high compression ratio than a low compression ratio. The control shaft torque Tcs is greater at a high compression ratio than a low compression ratio. A load generated by combustion acts to rotate the control shaft 7 in the clockwise direction of the figure, or in other words a low compression ratio direction.

Hence, with this constitution, the compression ratio can be varied quickly from a high compression ratio region, in which knocking is likely to occur, to a low compression ratio. As a result, an acceleration performance of the internal combustion engine can be improved while avoiding knocking.

When the compression ratio is varied from a high compression ratio to a low compression ratio, the displacement amount of the piston top dead center position per unit rotation angle of the control shaft 7 decreases as the compression ratio approaches a target compression ratio. Meanwhile, the control shaft torque Tcs decreases as the compression ratio decreases. Therefore, the variation speed of the compression ratio decreases as the compression ratio decreases.

Moreover, as the compression ratio decreases, the bending load acting on the actuator rod 13 increases, and friction between the actuator rod 13 and the housing 16 increases. As a result, the variation speed of the compression ratio decreases further.

For these reasons, in the variable compression ratio device according to this embodiment, there is no need or almost no need to apply the torque of the electric motor 18 when varying the compression ratio from a high compression ratio to a low compression ratio to ensure that the compression ratio variation speed does not become excessive as the compression ratio decreases. Accordingly, the amount of energy consumed to drive the electric motor 18 can be reduced. A constitution in which the effective arm length reaches a maximum at the maximum compression ratio and reaches a minimum at the minimum compression ratio, and in which F1/F2 reaches a minimum at the maximum compression ratio, is not limited to the constitution shown in FIG. 14.

Figure 15:
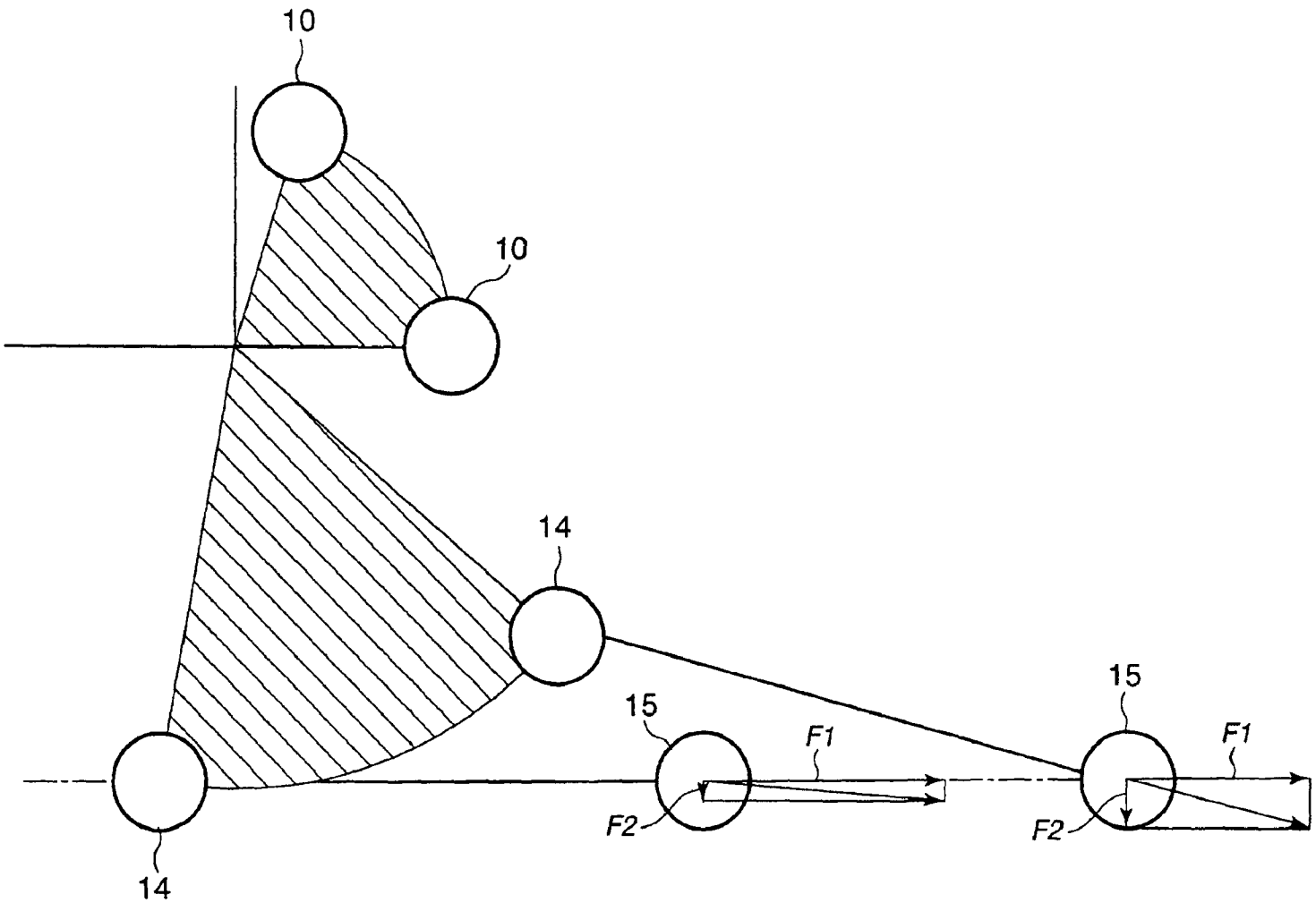
FIG. 15 is a diagram showing a variation relating to the movable range of the variable compression ratio device according to the third embodiment of this invention.
Figure 16:
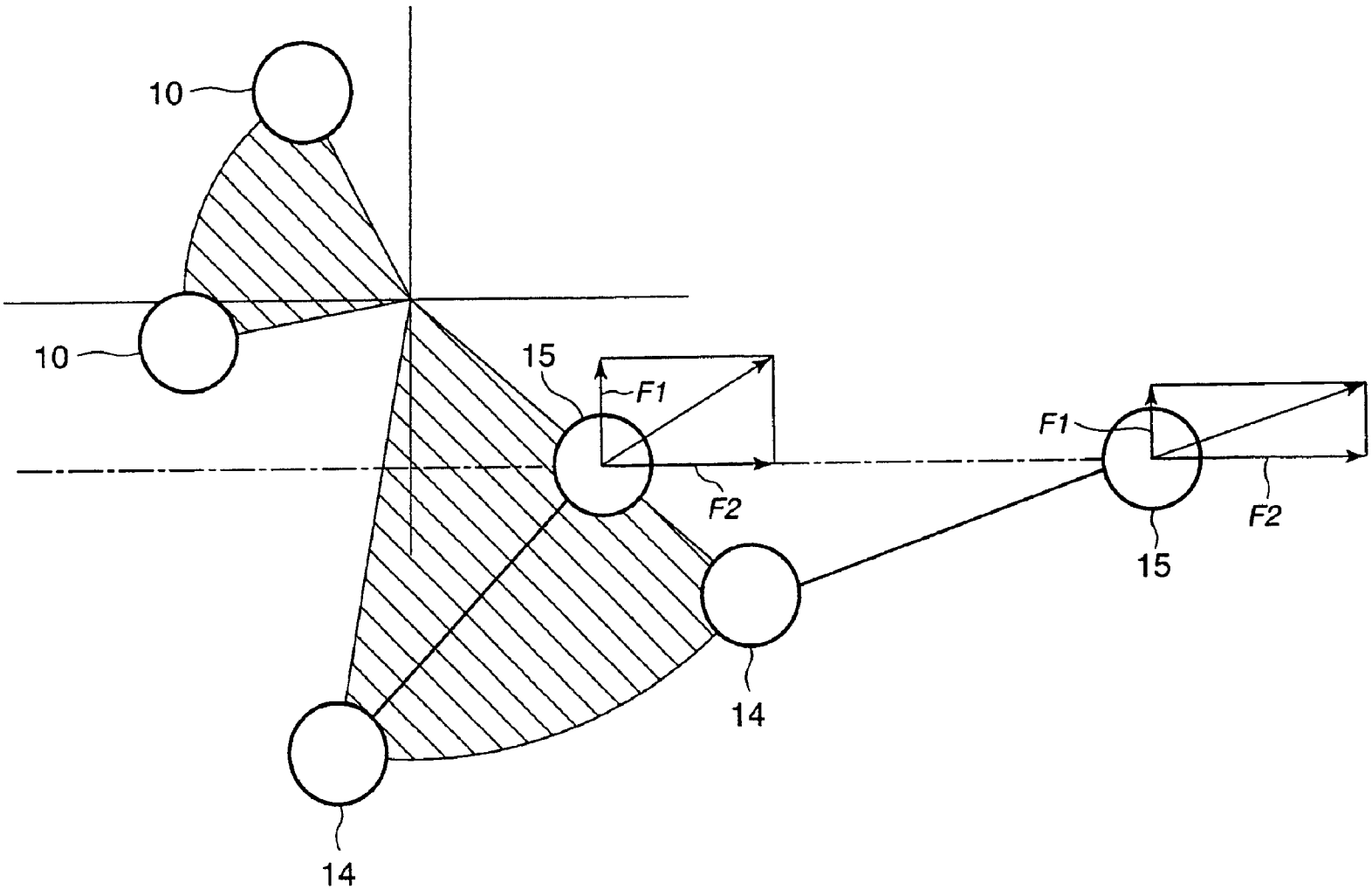
FIG. 16 is a diagram showing another variation relating to the movable range of the variable compression ratio device according to the third embodiment of this invention.
Figure 17:
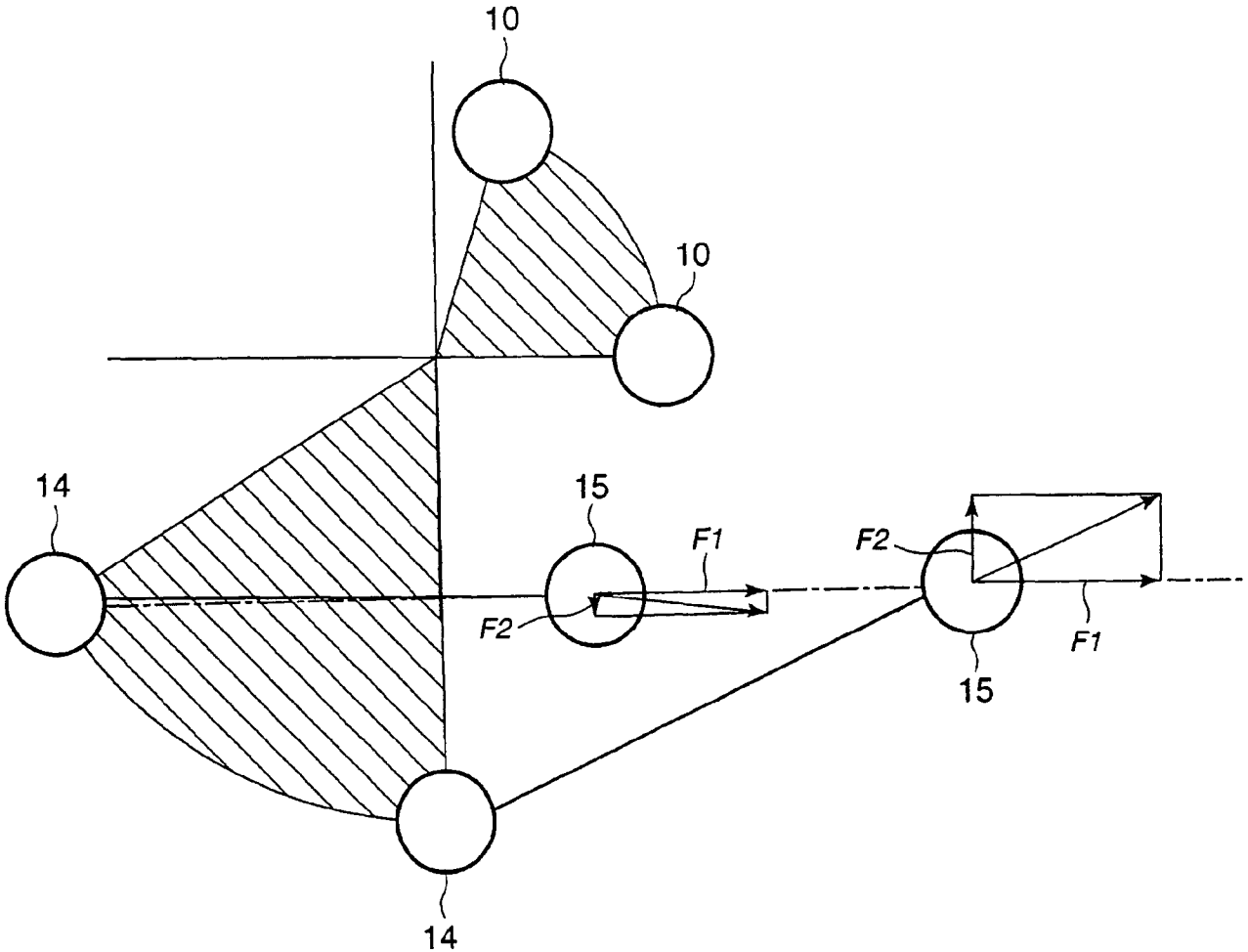
FIG. 17 is a diagram showing yet another variation relating to the movable range of the variable compression ratio device according to the third embodiment of this invention.

FIGS. 15-17 show a variation of this embodiment relating to the positions of the offset pin 10 and the connecting pin 14 at the maximum compression ratio and the minimum compression ratio. For convenience, the displacement range of the offset pin 10, the connecting pin 14, and the connecting pin 15 is indicated here by referring to zero degrees$\leqq\theta_{cs}$<90 degrees as a first quadrant, 90 degrees$\leqq\theta_{cs}$<180 degrees as a second quadrant, 180 degrees$\leqq\theta_{cs}$<270 degrees as a third quadrant, and 270 degrees$\leqq\theta_{cs}$<360 degrees as a fourth quadrant.

Referring to FIG. 15, substantially the entire region of displacement of the offset pin 10 is positioned in the first quadrant, and substantially the entire region of displacement of the connecting pin 14 is positioned in the fourth quadrant. The locus of the connecting pin 14 is positioned above the axis of the actuator rod 13 over substantially the entire region from the maximum compression ratio to the minimum compression ratio, but contacts or intersects the axis of the actuator rod 13 in the vicinity of the maximum compression ratio.

Referring to FIG. 16, substantially the entire region of displacement of the offset pin 10 is positioned in the second quadrant, and substantially the entire region of displacement of the connecting pin 14 is positioned in the fourth quadrant. The locus of the connecting pin 14 is positioned below the axis of the actuator rod 13 over the entire region from the maximum compression ratio to the minimum compression ratio.

Referring to FIG. 17, substantially the entire region of displacement of the offset pin 10 is positioned in the first quadrant, and substantially the entire region of displacement of the connecting pin 14 is positioned in the third quadrant. The locus of the connecting pin 14 is positioned below the axis of the actuator rod 13 over substantially the entire region from the maximum compression ratio to the minimum compression ratio.

Likewise with the constitutions shown in FIGS. 15-17, it is possible to satisfy conditions according to which the effective arm length reaches a maximum at the maximum compression ratio and reaches a minimum at the minimum compression ratio, and F1/F2 reaches a minimum at the maximum compression ratio.

Figure 22A:
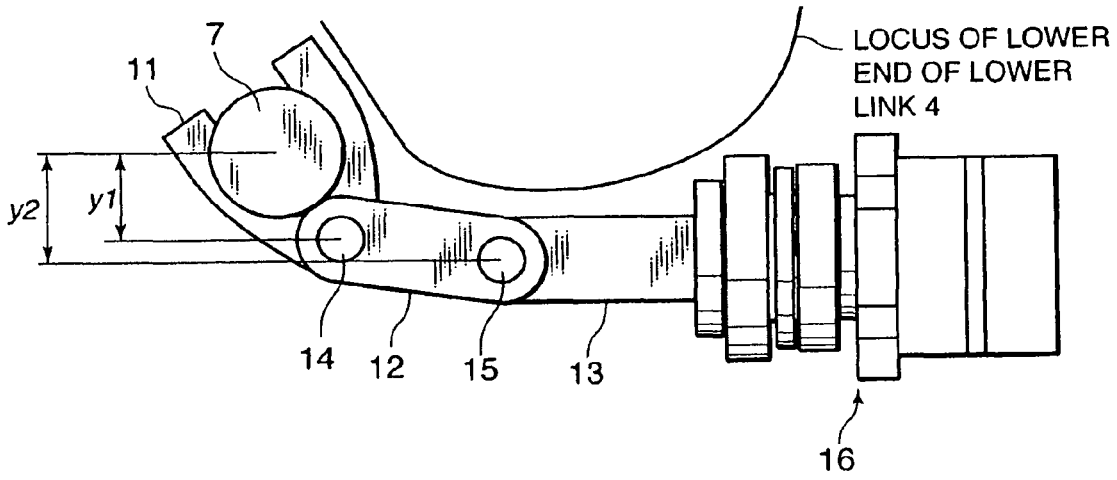
FIGS. 22A and 22B are diagrams showing positional relationships between the fixing lever, the connecting link, and the actuator rod at the maximum compression ratio and the minimum compression ratio of the variable compression ratio device shown in FIGS. 14A, 14B and 15.
Figure 22B:
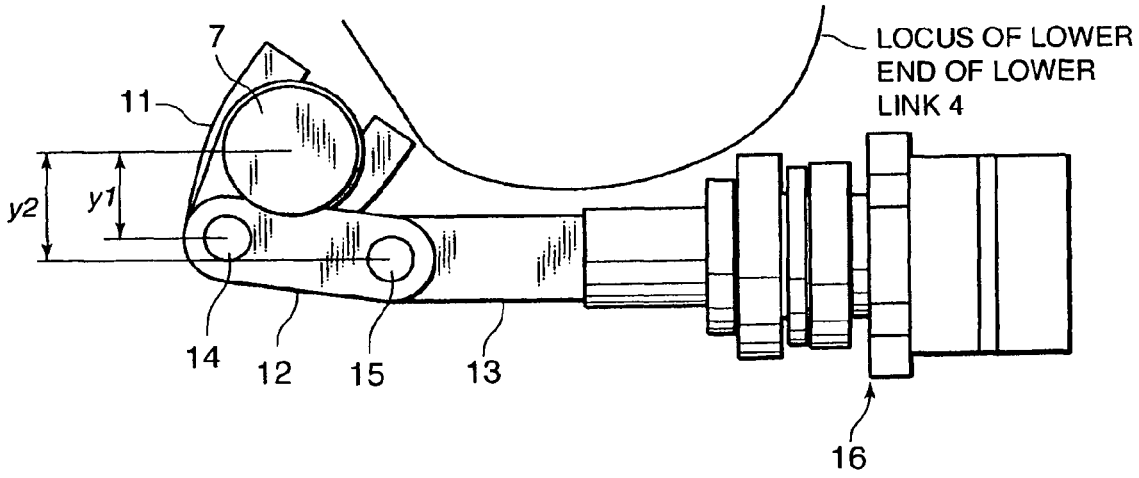
Figure 23A:
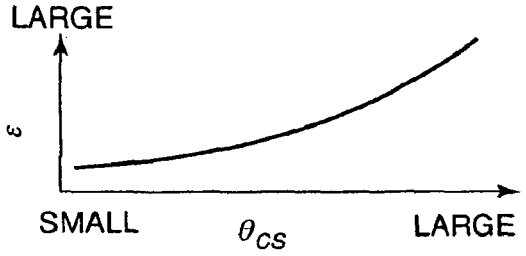
FIGS. 23A-23G are diagrams showing the characteristics of various parameters relating to variation in the control shaft angle $\theta_{cs}$ and the compression ratio $\epsilon$ of the variable compression ratio device shown in FIGS. 14A, 14B and 15.

Referring to FIGS. 22A and 23A, With the constitution of the variable compression ratio device shown in FIGS. 14A, 14B and 15, a distance y2 between the axis of the actuator rod 13 and the center of the control shaft 7 is larger than a distance y1 between the connecting pin 14 and the center of the control shaft 7 in relation to the transverse direction of the actuator rod 13 over substantially the entire compression ratio region. FIG. 22A shows the state of the fixing lever 11, connecting link 12, and actuator rod 13 at the maximum compression ratio. FIG. 22B shows the state of the fixing lever 11, connecting link 12, and actuator rod 13 at the minimum compression ratio. Solid line above the actuator rod 13 in the figures represents the locus of a lower end of the lower link 4 during an operation.

With this constitution, the magnitude of the transverse direction load F1 applied to the actuator rod 13 in the variable compression ratio device shown in FIGS. 14A, 14B and 15 is substantially constant over the entire compression ratio region.

The reason for this will now be described with reference to FIGS. 23A-23G and FIGS. 24A-24G. FIGS. 23A-23G show characteristics of the variable compression ratio devices shown in FIGS. 14A, 14B and 15.

FIG. 23A shows a characteristic of compression ratio variation relative to the rotation angle $\theta_{cs}$ of the control shaft 7. The compression ratio increases in the form of a quadratic curve as the rotation angle $\theta_{cs}$ of the control shaft 7 increases.

Figure 23B:
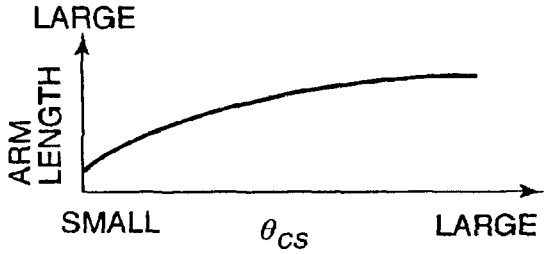

FIG. 23B shows a characteristic of effective arm length variation relative to the rotation angle $\theta_{cs}$ of the control shaft 7. The effective arm length increases as the rotation angle $\theta_{cs}$ of the control shaft 7 increases, but the increase rate of the effective arm length decreases as the rotation angle $\theta_{cs}$ of the control shaft 7 increases.

Figure 23C:
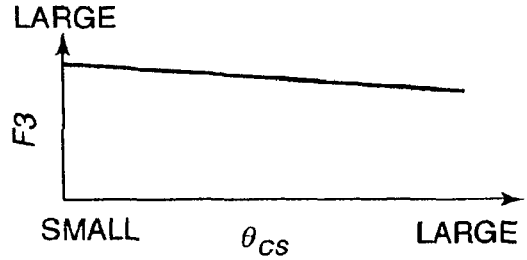

FIG. 23C shows a characteristic of variation in the load F3 on the control shaft 7 relative to the rotation angle $\theta_{cs}$ of the control shaft 7. The load F3 decreases as the rotation angle $\theta_{cs}$ of the control shaft 7 increases.

Figure 23D:
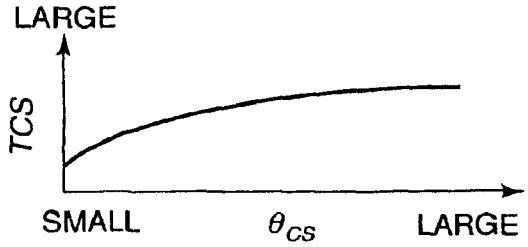

FIG. 23D shows a relationship between the rotation angle $\theta_{cs}$ of the control shaft 7 and the control shaft torque Tcs. The control shaft torque Tcs is the product of the load F3 on the control shaft 7 and the effective arm length. As noted above, the effective arm length affects the control shaft torque Tcs greatly, and therefore the control shaft torque Tcs exhibits a similar characteristic to the effective arm length.

Figure 23E:
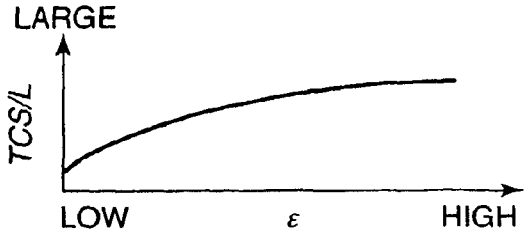

FIG. 23E shows a relationship between the compression ratio and a value obtained by dividing the control shaft torque Tcs by the length L of the fixing lever 11, or in other words the magnitude of the load acting on the connecting pin 15. The load acting on the connecting pin 15 also exhibits a similar characteristic to the effective arm length.

Figure 23F:
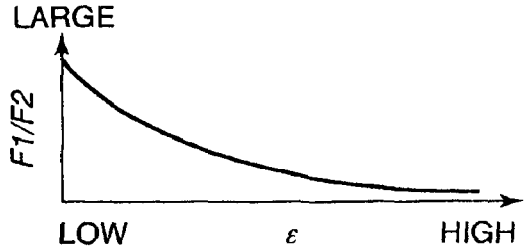

FIG. 23F shows variation in F1/F2 relative to the compression ratio. As the compression ratio increases, F1/F2 decreases. The variation rate thereof decreases as the compression ratio increases.

It should be noted that in the constitution shown in FIG. 15, the connecting pin 14 is in the third quadrant in the vicinity of the maximum compression ratio, and therefore, strictly speaking, the characteristic in the vicinity of the maximum compression ratio in FIGS. 23E and 23F differs from that of the constitution shown in FIG. 14. However, when compared over the entire compression ratio region, these characteristics may be considered more or less identical.

Figure 23G:
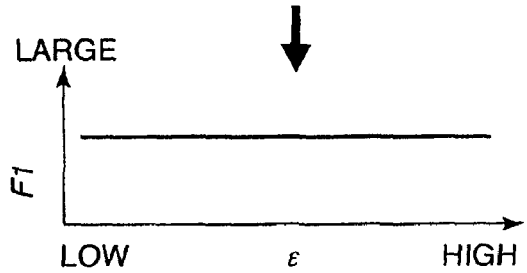

FIG. 23G shows variation in the transverse direction load F1 applied to the actuator rod 13 relative to the compression ratio. The load F1 is expressed by the product of Tcs/L shown in FIG. 23E and F1/F2 shown in FIG. 23F. As the compression ratio increases, Tcs/L increases and the variation rate thereof decreases. As the compression ratio increases, F1/F2 decreases and the variation rate thereof also decreases. Since Tcs/L and F1/F2 cancel each other out, the load F1 remains substantially constant, regardless of the compression ratio.

FIGS. 24A-24G show characteristics of the variable compression ratio devices shown in FIGS. 16 and 17.

Figure 24A:
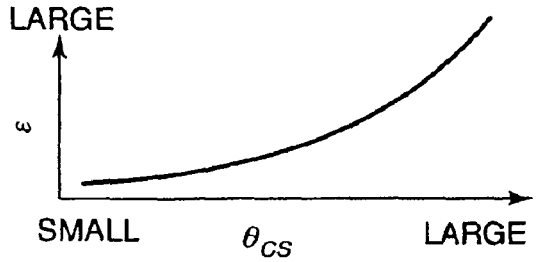
FIGS. 24A-24G are diagrams showing the characteristics of various parameters relating to variation in the control shaft angle $\theta_{cs}$ and the compression ratio $\epsilon$ of the variable compression ratio device shown in FIGS. 16 and 17.
Figure 24E:
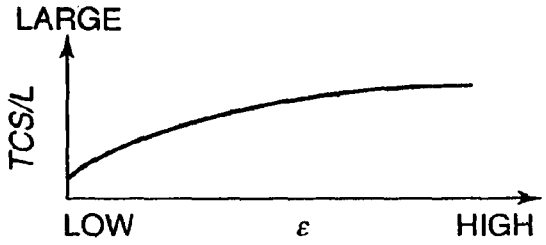
Figure 24B:
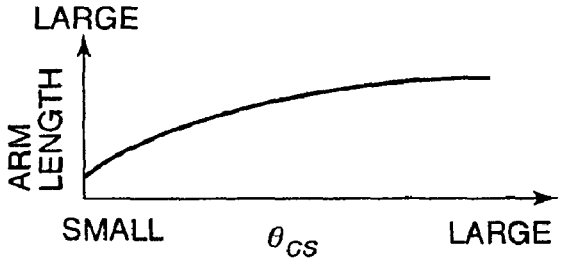
Figure 24F:
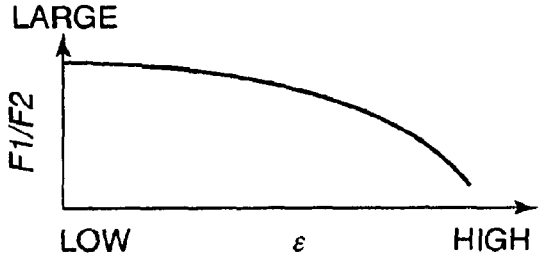
Figure 24C:
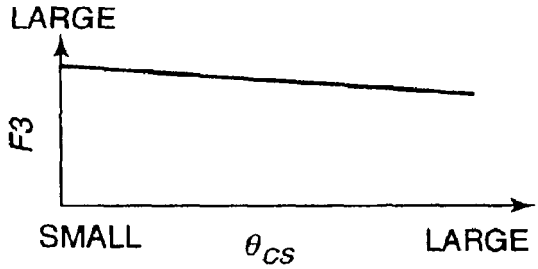
Figure 24G:
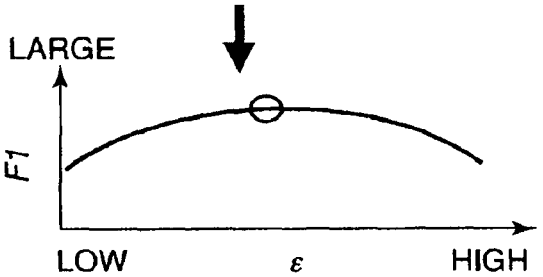
Figure 24D:
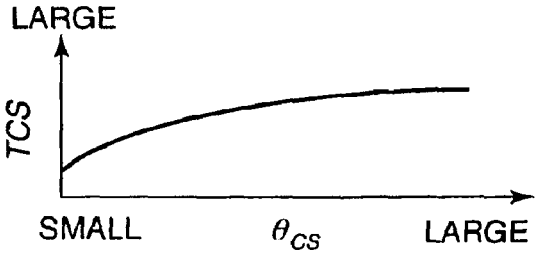

The characteristics shown in FIGS. 24A-24E are similar to those shown in FIGS. 23A-23E. However, in the characteristic shown in FIG. 24F, while the value of F1/F2 decreases as the compression ratio increases as in the case of FIG. 23F, the variation rate thereof increases, in contrast to the characteristic shown in FIG. 23F. Therefore, in the variable compression ratio device constituted as shown in FIGS. 16 and 17, Tcs/L and F1/F2 do not cancel each other out, and the magnitude of F1 reaches a maximum at an intermediate compression ratio, as shown in FIG. 24G.

In comparison with the variable compression ratio devices constituted as shown in FIG. 16 and FIG. 17, in the variable compression ratio device constituted as shown in FIGS. 14A, 14B and 15, F1 increases in the vicinity of the minimum compression ratio and the maximum compression ratio, but decreases in other regions and has a smaller maximum value. When considering the entire compression ratio region, the variable compression ratio device constituted as shown in FIGS. 14A, 14B and 15 exhibits a greater F1 reduction effect than the variable compression ratio device constituted as shown in FIG. 16 or FIG. 17.

Referring to FIGS. 18-21, a fourth embodiment of this invention will be described.

A variable compression ratio device according to this embodiment differs from the first embodiment in the displacement region of the offset pin 10, the connecting pin 14, and the connecting pin 15.

Figure 18:
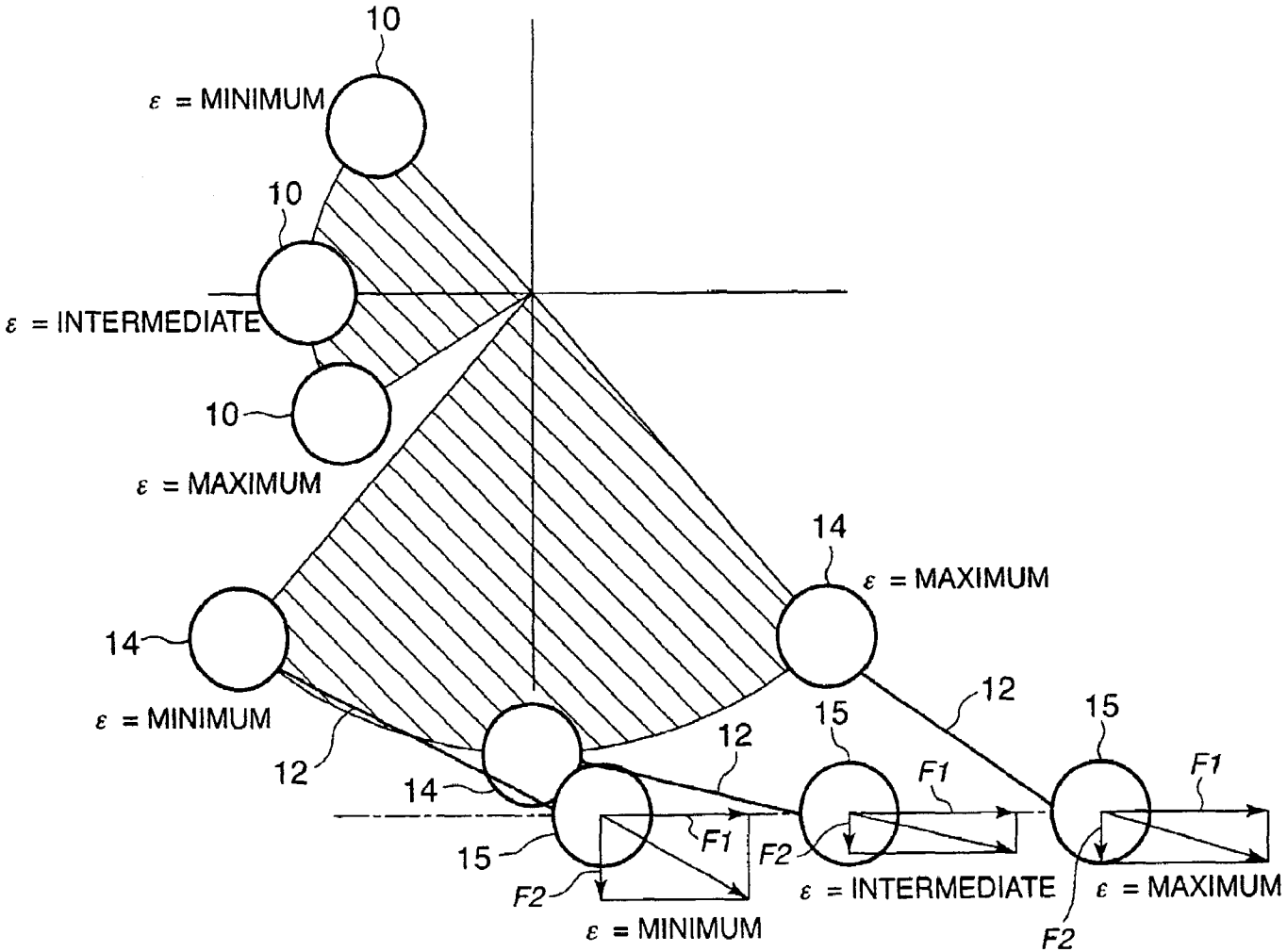
FIG. 18 is a diagram showing the movable range of a variable compression ratio device according to a fourth embodiment of this invention.

Referring to FIG. 18, in the variable compression ratio device according to this embodiment, the offset pin 10 displaces over the second quadrant and third quadrant so as to be positioned in the second quadrant at the minimum compression ratio and in the third quadrant at the maximum compression ratio.

The connecting pin 14 displaces over the third quadrant and fourth quadrant so as to be positioned in the third quadrant at the minimum compression ratio and in the fourth quadrant at the maximum compression ratio. Furthermore, the connecting pin 14 is positioned above the axis of the actuator rod 13 throughout the entire displacement region, and comes closest to the axis of the actuator rod 13 at the intermediate compression ratio.

By setting the dimensions and arrangement of the links to satisfy these conditions, the effective arm length for converting an axial direction load of the control link 5 into a rotational torque of the rotation axis 7*a* reaches a maximum when the rotation angle $\theta_{cs}$ of the control shaft 7 reaches 270 degrees at the intermediate compression ratio. In this state, the distance between the connecting pin 14 and the axis of the actuator rod 13 is at a minimum, and therefore F1/F2 is also at a minimum. With this constitution, the maximum value of the bending load that acts on the actuator rod 13 can be reduced.

The displacement amount of the piston top dead center position per unit rotation angle of the control shaft 7 has an equal maximum value to a case in which the variation range of the offset pin 10 is limited to the first quadrant or the second quadrant alone, but a larger minimum value. In other words, the displacement amount of the piston top dead center position per unit rotation angle of the control shaft 7 is larger in terms of the entire compression ratio region. Further, similarly to the third embodiment, the combustion load increases as the compression ratio decreases. Hence, when the variable compression ratio device according to this embodiment is used, the compression ratio can be varied quickly from a high compression ratio to a low compression ratio.

Figure 19:
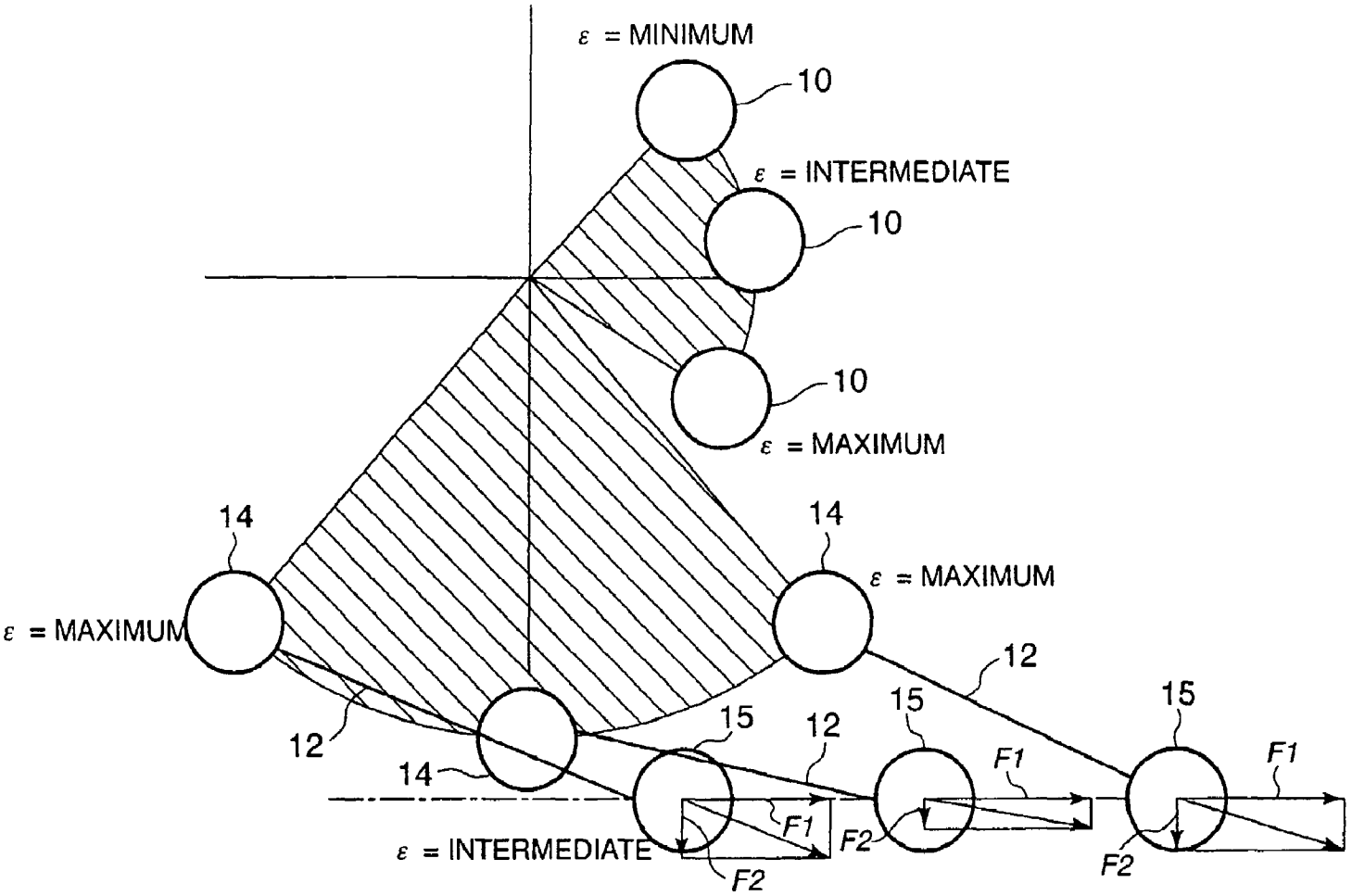
FIG. 19 is a diagram showing a variation relating to the movable range of the variable compression ratio device according to the fourth embodiment of this invention.
Figure 20:
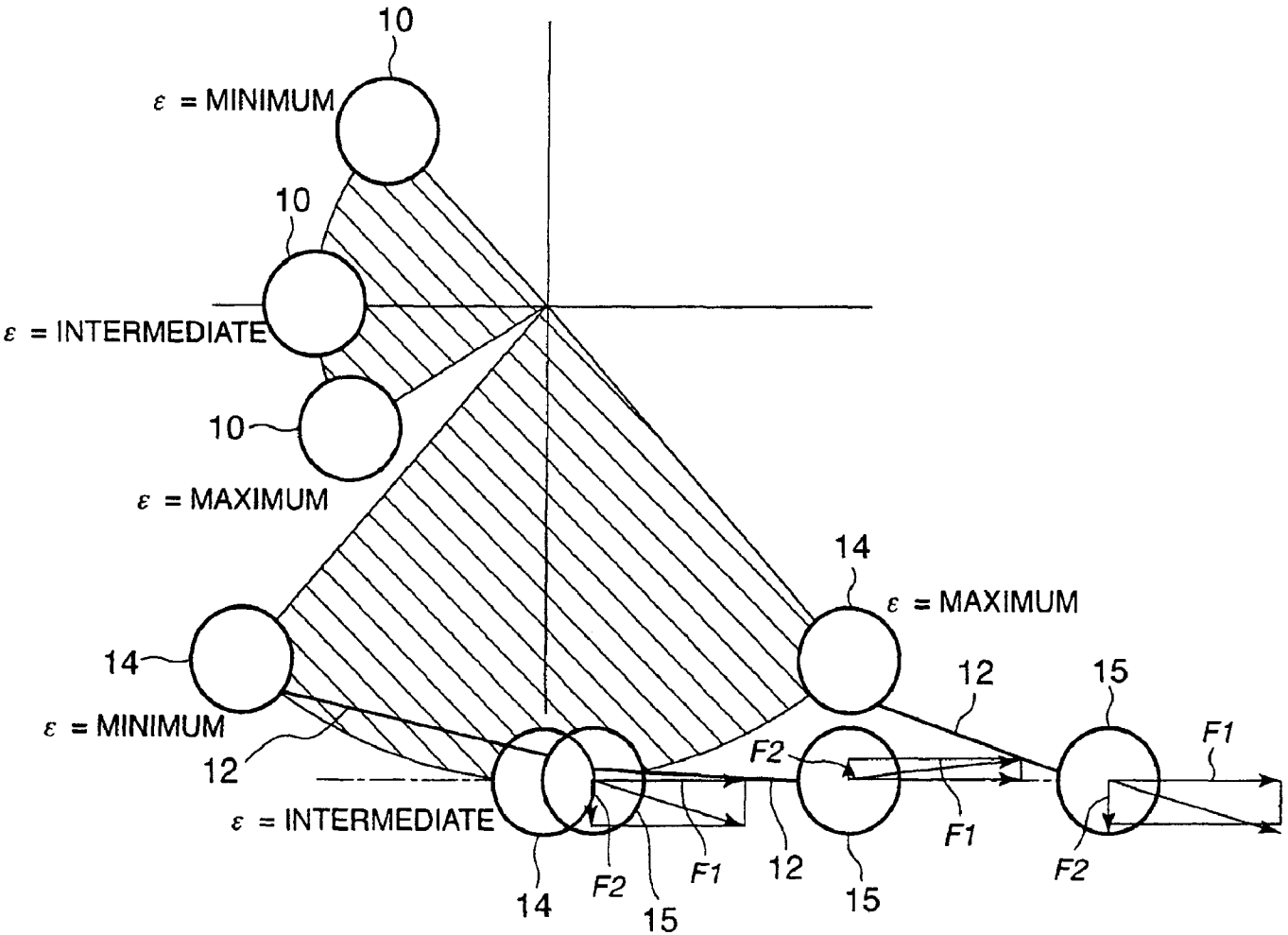
FIG. 20 is a diagram showing another variation relating to the movable range of the variable compression ratio device according to the fourth embodiment of this invention.
Figure 21:
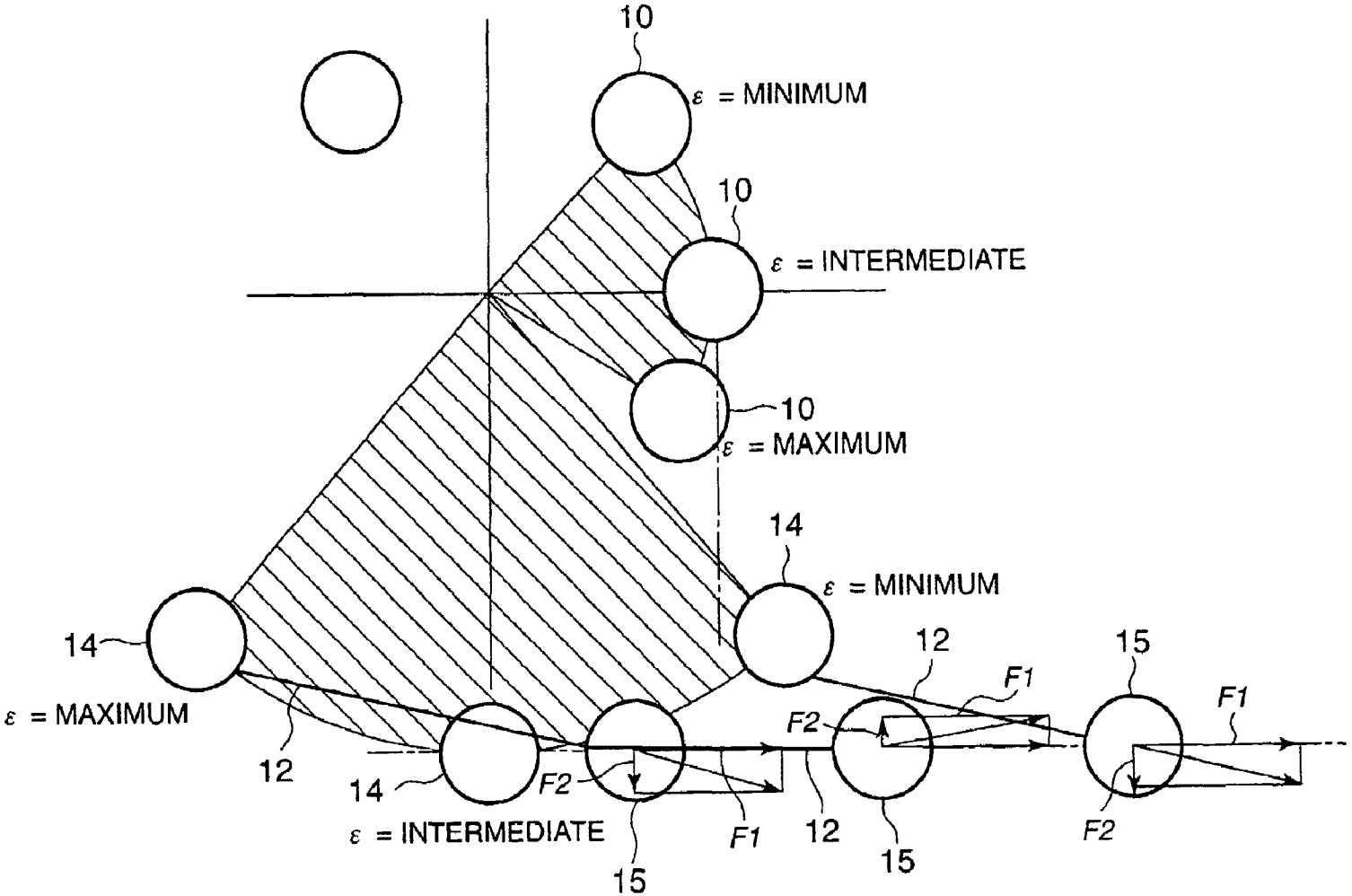
FIG. 21 is a diagram showing yet another variation relating to the movable range of the variable compression ratio device according to the fourth embodiment of this invention.

It should be noted that similar effects to this embodiment can be obtained by constituting the variable compression ratio device as shown in FIGS. 19-21.

FIGS. 19-21 show a variation of this embodiment relating to the positions of the offset pin 10 and the connecting pin 14 at the maximum compression ratio, the intermediate compression ratio, and the minimum compression ratio.

In FIG. 19, the offset pin 10 displaces over the fourth quadrant and the first quadrant so as to be positioned in the fourth quadrant at the maximum compression ratio and in the first quadrant at the minimum compression ratio. At the intermediate compression ratio, the rotation angle $\theta_{cs}$ of the control shaft 7 is substantially zero degrees. The connecting pin 14 displaces over the third quadrant and the fourth quadrant so as to be positioned in the third quadrant at the maximum compression ratio and in the fourth quadrant at the minimum compression ratio. At the intermediate compression ratio, the rotation angle $\theta_{cs}$ of the control shaft 7 is substantially 270 degrees. Further, the locus of the connecting pin 14 is positioned above the axis of the actuator rod 13 over the entire compression ratio region.

In FIG. 20, the offset pin 10 displaces over the second quadrant and the third quadrant so as to be positioned in the third quadrant at the maximum compression ratio and in the second quadrant at the minimum compression ratio. At the intermediate compression ratio, the rotation angle $\theta_{cs}$ of the control shaft 7 is substantially 180 degrees. The connecting pin 14 displaces over the third quadrant and the fourth quadrant so as to be positioned in the third quadrant at the minimum compression ratio and in the fourth quadrant at the maximum compression ratio. At the intermediate compression ratio, the rotation angle $\theta_{cs}$ of the control shaft 7 is substantially 270 degrees. Further, the locus of the connecting pin 14 is positioned above the axis of the actuator rod 13 at the maximum compression ratio and the minimum compression ratio, and either contacts or is positioned below the axis of the actuator rod 13 at the intermediate compression ratio.

In FIG. 21, the offset pin 10 displaces over the fourth quadrant and the first quadrant so as to be positioned in the fourth quadrant at the maximum compression ratio and in the first quadrant at the minimum compression ratio. At the intermediate compression ratio, the rotation angle $\theta_{cs}$ of the control shaft 7 is close to zero degrees. The connecting pin 14 displaces over the third quadrant and the fourth quadrant so as to be positioned in the third quadrant at the maximum compression ratio and in the fourth quadrant at the minimum compression ratio. At the intermediate compression ratio, the rotation angle $\theta_{cs}$ of the control shaft 7 is substantially 270 degrees. Further, the locus of the connecting pin 14 is positioned above the axis of the actuator rod 13 at the maximum compression ratio and the minimum compression ratio, and either contacts or is positioned below the axis of the actuator rod 13 at the intermediate compression ratio.

According to the constitution shown in FIGS. 18-21, the displacement amount of the top dead center position of the piston 1 per unit rotation angle of the control shaft 7 reaches a maximum at the intermediate compression ratio and reaches a minimum at the maximum compression ratio and the minimum compression ratio. The minimum value thereof is larger than the minimum value of the variable compression ratio device according to the third embodiment, shown in FIGS. 14A, 14B and 15. In comparison with the variable compression ratio device according to the third embodiment, shown in FIGS. 14A, 14B and 15, the displacement amount of the top dead center position of the piston 1 per unit rotation angle of the control shaft 7 is larger over the entire compression ratio region. Further, the combustion load applies a greater torque on the control shaft 7 to rotate it in a direction toward the low compression ratio side. Hence, the responsiveness of an operation to modify the compression ratio in a low compression ratio direction can be improved.

Figure 25A:
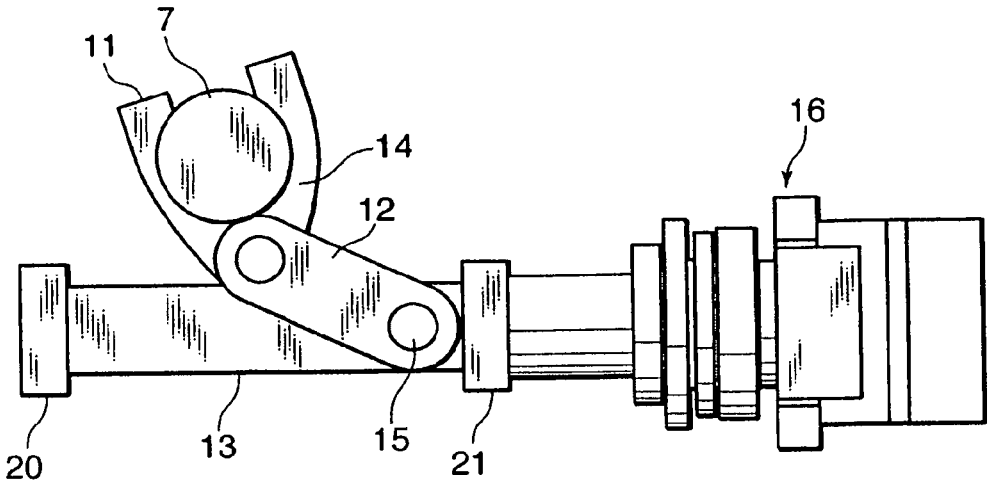
FIGS. 25A and 25B are diagrams showing positional relationships between the fixing lever, the connecting link, and the actuator rod at the maximum compression ratio and the minimum compression ratio of a variable compression ratio device according to a fifth embodiment of this invention.
Figure 25B:
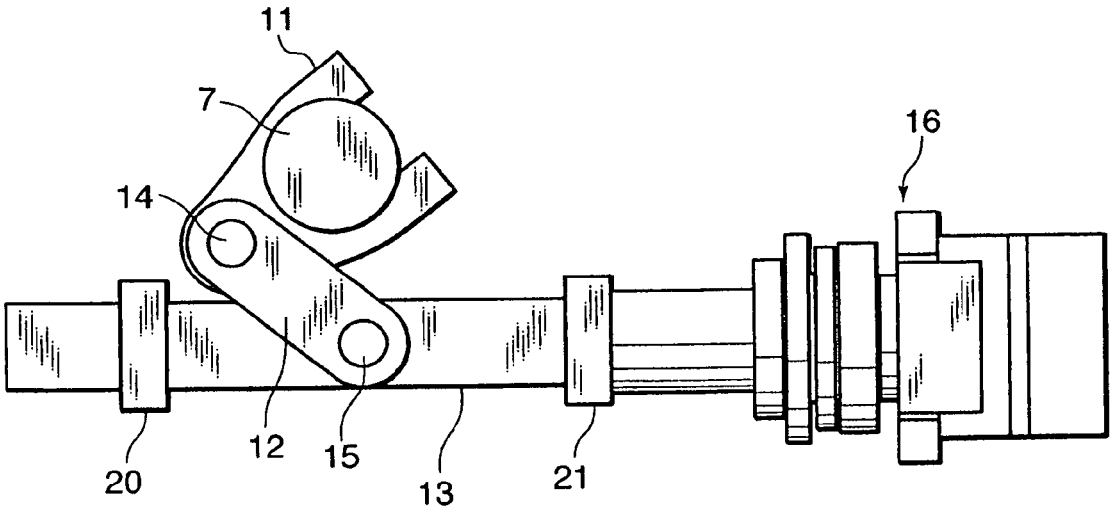

A fifth embodiment of this invention will now be described with reference to FIGS. 25A and 25B.

This embodiment is similar to the first embodiment, but differs therefrom in the constitution of the actuator rod 13.

This embodiment comprises a support member 20 and a support member 21 which latch the second connecting pin 15 to an intermediate portion of the actuator rod 13 and support the actuator rod 13. The support member 20 and the support member 21 are disposed on either side of the connecting pin 15 relative to the axial direction of the actuator rod 13. The actuator rod 13 penetrates the support member 20 and the support member 21 so as to be free to slide. The support members 20 and 21 are fixed to the cylinder block of the internal combustion engine, for example.

By providing the support members 20 and 21, bending direction deformation of the actuator rod 13 can be suppressed. In other words, the diameter of the actuator rod 13 can be reduced while securing bending rigidity relative to a load input from the connecting pin 15. Hence, the housing 16 does not have to be increased in size to secure rigidity.

The distance y1 between the connecting pin 14 and the center of the control shaft 7 and a ratio y2/y1 of the distance y2 between the axis of the actuator rod 13 and the center of the control shaft 7 and the distance y1 between the connecting pin 14 and the center of the control shaft 7, in relation to the transverse direction of the actuator rod 13, may be set larger than the variable compression ratio device according to the third embodiment, shown in FIGS. 22A and 22B. By increasing y1/y2, the actuator rod 13 and the control shaft 7 can be disposed in removed positions. Disposing the actuator rod 13 and the control shaft 7 in this manner is preferable to avoid interference between peripheral components of the actuator rod 13 and support members of the control shaft 7, members such as the control link 5 and the lower link 4, and so on.

The contents of Tokugan 2007-209516, with a filing date of Aug. 10, 2007 in Japan, are hereby incorporated by reference.

Although the invention has been described above with reference to certain embodiments, the invention is not limited to the embodiments described above. Modifications and variations of the embodiments described above will occur to those skilled in the art, within the scope of the claims.

The embodiments of this invention in which an exclusive property or privilege is claimed are defined as follows:

The embodiments of this invention in which an exclusive property or privilege is claimed are defined as follows:

The invention claimed is:

1. A variable compression ratio device for an internal combustion engine, comprising:

a rotatable control shaft configured to selectively vary a compression ratio of the internal combustion engine in accordance with a rotational displacement;

a plurality of links that connect a piston of the internal combustion engine to a crankshaft;

a control link that connects one of the plurality of the links to an offset point that is offset from a rotation axis of the control shaft, the control link rotating with respect to the control shaft;

a linear actuator comprising a housing and an actuator rod that elongates and contracts relative to the housing; and a connecting link that connects the control shaft to the actuator rod, the connecting link being rotatably connected to the control shaft via a first connecting pin having a center axis offset from the rotation axis of the control shaft, and the connecting link being rotatably connected to the actuator rod via a second connecting pin disposed parallel to the first connecting pin.

2. The variable compression ratio device as defined in claim 1, wherein:

the actuator rod has a center axis along which the actuator rod extends relative to the housing, a movement region of the first connecting pin is divided into a low compression ratio region and a high compression ratio region by a line that is perpendicular to the center axis of the actuator rod and passes through a rotation axis of the control shaft, the low compression ratio region is larger than the high compression ratio region, and a movement amount of the actuator rod per rotation angle of the control shaft is larger when the first connecting pin is in the high compression ratio region than when the first connecting pin is in the low compression ratio region.

3. The variable compression ratio device as defined in claim 1, wherein the connecting link and the actuator rod form a substantially straight line at a maximum compression ratio.

4. The variable compression ratio device as defined in claim 1, wherein the actuator rod has a center axis along which the actuator rod extends relative to the housing, and a locus of the first connecting pin intersects the center axis of the actuator rod.

5. The variable compression ratio device as defined in claim 1, wherein the offset point is set in a position such that an arm length of a moment applied to the control shaft by the control link increases as the compression ratio increases.

6. The variable compression ratio device as defined in claim 1, wherein the offset point is set in a position such that an arm length of a moment applied to the control shaft by the control link decreases as the compression ratio increases.

7. The variable compression ratio device as defined in claim 1, wherein the connecting link is forked, and one end of the actuator rod is connected to the fork via the second connecting pin.

8. The variable compression ratio device as defined in claim 1, wherein the linear actuator comprises:

an electric motor; and a ball screw reduction gear configured to convert a rotation of the electric motor into a linear motion using a screw feeding mechanism.

9. The variable compression ratio device as defined in claim 1, wherein, when a component of a load applied to the actuator rod by the connecting link that acts in a transverse direction of the actuator rod is defined as F1, a component of the load applied to the actuator rod by the connecting link that acts in an axial direction of the actuator rod is defined as F2, and a moment applied to the control shaft by the control link is defined as a control shaft torque, the variable compression ratio device is configured such that at a compression ratio at which the control shaft torque reaches a maximum, a ratio F1/F2 reaches a minimum.

10. The variable compression ratio device as defined in claim 9, wherein the compression ratio at which the control shaft torque reaches a maximum is equal to a compression ratio at which the arm length of the moment applied to the control shaft by the control link reaches a maximum.

11. The variable compression ratio device as defined in claim 9, wherein the variable compression ratio device is further configured such that the control shaft torque is larger on a high compression ratio side of an intermediate compression ratio located between a maximum compression ratio and a minimum compression ratio than on a low compression ratio side of the intermediate compression ratio, and the ratio F1/F2 is smaller on the high compression ratio side than on the low compression ratio side.

12. The variable compression ratio device as defined in claim 11, wherein, in relation to the transverse direction of the actuator rod, a distance between the first connecting pin and the rotation axis of the control shaft is larger than a distance between an axis of the actuator rod and the rotation axis of the control shaft over an entire compression ratio region.

13. The variable compression ratio device as defined in claim 9, wherein the variable compression ratio device is further configured such that the control shaft torque is larger on a high compression ratio side of an intermediate compression ratio located between a maximum compression ratio and a minimum compression ratio than on a low compression ratio side of the intermediate compression ratio, and an average distance between the second connecting pin and an axis of the actuator rod is shorter on the high compression ratio side than on the low compression ratio side.

14. The variable compression ratio device as defined in claim 9, wherein the variable compression ratio device is further configured such that the control shaft torque reaches the maximum and the ratio F1/F2 reaches the minimum at an intermediate compression ratio located between a maximum compression ratio and a minimum compression ratio.

15. The variable compression ratio device as defined in claim 9, wherein the variable compression ratio device is further configured such that the control shaft torque reaches the maximum and a distance between the first connecting pin and an axis of the actuator rod reaches a minimum at an intermediate compression ratio located between a maximum compression ratio and a minimum compression ratio.

16. The variable compression ratio device as defined in claim 9, further comprising a group of support members that connect the connecting link to an intermediate portion of the actuator rod via the second connecting pin and support the actuator rod to be free to slide on either side of the second connecting pin in relation to an axial direction of the actuator rod.

* * * * *